US012213604B2

(12) United States Patent
Burgert et al.

(10) Patent No.: US 12,213,604 B2
(45) Date of Patent: Feb. 4, 2025

(54) FULL WING DISPLAY

(71) Applicant: Menasha Corporation, Neenah, WI (US)

(72) Inventors: Gina L. Burgert, Neenah, WI (US); Amy Melnick, Northbrook, IL (US); Colleen Wills, New Lenox, IL (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 18/496,467

(22) Filed: Oct. 27, 2023

(65) Prior Publication Data

US 2024/0130543 A1 Apr. 25, 2024
US 2024/0225313 A9 Jul. 11, 2024

Related U.S. Application Data

(63) Continuation of application No. 17/235,331, filed on Apr. 20, 2021, now Pat. No. 11,832,741, which is a continuation of application No. 16/819,528, filed on Mar. 16, 2020, now Pat. No. 11,019,943.

(60) Provisional application No. 62/819,118, filed on Mar. 15, 2019.

(51) Int. Cl.
*A47F 5/11* (2006.01)

(52) U.S. Cl.
CPC ..... *A47F 5/116* (2013.01)

(58) Field of Classification Search
CPC .... A47F 5/10; A47F 5/116; A47F 5/11; A47F 5/112; A47B 43/02; A47B 45/00; A47B 43/00; A47B 47/06; A47B 55/06
USPC ..... 211/207, 174, 175, 149
See application file for complete search history.

(56) References Cited

U.S. PATENT DOCUMENTS 1,827,008 A * 10/1931 Huckel ..... A47F 7/144 211/134
1,912,847 A * 6/1933 Klepel ..... B62B 3/003 206/509
1,992,373 A * 2/1935 Johnson ..... B65D 5/721 206/268
2,018,707 A * 10/1935 Daller ..... B65D 5/545 229/223
D104,437 S * 5/1937 Bulman ..... D6/675.3
2,150,743 A * 3/1939 Mancuso ..... G09F 5/00 229/108.1
2,174,715 A * 10/1939 Baker ..... A47F 7/28 211/49.1

(Continued)

*Primary Examiner* — Devin K Barnett
(74) *Attorney, Agent, or Firm* — Richard C. Himelhoch; UB Greensfelder LLP

(57) ABSTRACT

A corrugated paper display moveable from a stowed condition to a display condition is described herein. The display has a first rectangular sleeve having opposed lateral edges, a front edge, and a back edge. Two side panels one of each are attached respectively to one of each of the two opposed lateral edges. A back wall is connected to the back edge and the two side panels. A rectangular display compartment extends between the opposed side walls and a shelf is positioned in the rectangular display compartment. A front panel is hingedly connected to the first sleeve and rests on top of the first sleeve when in the stowed condition. When in the deployed condition, the front panel extends from the first sleeve to form a body of a second height which is 1.5 to 2.5 times greater than the first height.

17 Claims, 39 Drawing Sheets

(56) References Cited

U.S. PATENT DOCUMENTS 2,307,992 A * 1/1943 Calhoun ..... A47F 5/112 211/195
2,339,656 A * 1/1944 Shina ..... B65D 5/0005 206/268
D146,386 S * 2/1947 Shield ..... D6/678.3
D153,188 S * 3/1949 Stensgaard ..... D6/678.3
D158,775 S * 5/1950 Malkin ..... D6/672
D158,776 S * 5/1950 Malkin ..... D6/660
2,666,531 A * 1/1954 Anderson, Jr. ..... A47F 5/112 108/99
2,706,066 A * 4/1955 Wells ..... A47F 1/08 221/92
2,798,685 A * 7/1957 Mooney ..... B65D 19/0028 206/599
2,884,179 A * 4/1959 Rossum ..... B65D 5/48004 229/120.14
2,918,178 A * 12/1959 Leone ..... A47F 5/116 211/195
2,944,555 A * 7/1960 Peel ..... B65D 85/1045 206/268
2,975,890 A * 3/1961 Block ..... B65D 85/109 206/92
2,997,222 A * 8/1961 Sperry ..... A47F 5/112 211/130.1
3,000,602 A * 9/1961 O'Brien ..... B65D 19/12 108/53.5
3,026,015 A * 3/1962 Severn ..... B65D 19/20 206/600
3,026,078 A * 3/1962 Simkins ..... B65D 19/0016 108/51.3
3,058,646 A * 10/1962 Guyer ..... B65D 5/18 220/4.23
3,161,341 A * 12/1964 Farquhar ..... B65D 5/722 229/122.1
D204,434 S * 4/1966 Kingsford ..... D6/682.2
3,480,196 A * 11/1969 De Simas ..... B65D 19/20 229/122
3,514,031 A * 5/1970 Burgess ..... B65D 5/4802 229/120.08
3,528,559 A * 9/1970 Miller ..... E04B 2/7433 52/285.3
3,690,118 A * 9/1972 Rainwater ..... A47F 3/0447 62/250
3,696,990 A * 10/1972 Dewhurst ..... B65D 5/4608 206/427
3,730,417 A * 5/1973 Lawson ..... B65D 19/20 206/386
3,857,494 A * 12/1974 Giardini ..... A47B 47/05 108/53.5
3,879,053 A * 4/1975 Chvala ..... B62B 3/02 280/47.12
3,886,348 A * 5/1975 Jonathan ..... G09F 5/00 362/127
3,889,867 A * 6/1975 Berg ..... B65D 5/3621 229/122
3,944,128 A * 3/1976 Hogan ..... B65D 5/722 229/122
D239,805 S * 5/1976 Smith ..... D6/675
4,004,691 A * 1/1977 Wihksne ..... B65D 5/4229 229/122
D244,117 S * 4/1977 Naylor ..... D6/675.3
4,085,847 A * 4/1978 Jacalone ..... B65D 19/20 229/199
4,099,813 A * 7/1978 Olivan ..... B60R 7/04 211/88.01
4,171,741 A * 10/1979 Fish ..... B65D 85/68 217/43 A
4,271,766 A * 6/1981 Schmiedeler ..... A47B 43/02 108/115
4,283,000 A * 8/1981 White ..... B65D 5/722 229/148
4,292,901 A * 10/1981 Cox ..... B65D 71/0096 206/453
4,311,100 A * 1/1982 Gardner ..... A47F 5/116 108/165
4,375,874 A * 3/1983 Leotta ..... A47K 10/38 242/598.6
4,376,558 A * 3/1983 Bandar ..... B65D 5/48046 312/258
4,493,424 A * 1/1985 Smith ..... A47F 5/116 108/165
4,503,973 A * 3/1985 Andersson ..... B62B 5/0083 229/122.34
4,506,790 A * 3/1985 Muscari ..... A47F 5/116 211/59.4
D278,493 S * 4/1985 Brescia ..... D6/570
4,602,735 A * 7/1986 Aaron ..... B65D 5/722 229/122
4,610,355 A * 9/1986 Maurer ..... B65D 81/113 206/599
4,618,115 A * 10/1986 Belokin, Jr. ..... A47F 5/116 248/174
4,630,740 A * 12/1986 Belokin, Jr. ..... A47F 5/116 248/174
4,646,922 A * 3/1987 Smith ..... A47F 5/116 211/186
4,658,984 A * 4/1987 Brunner ..... B65D 83/02 206/443
4,673,092 A * 6/1987 Lamson ..... A47B 47/021 211/186
4,688,716 A * 8/1987 Winterling ..... B65D 5/0272 229/905
D292,659 S * 11/1987 Svezia ..... D6/675.4
D293,520 S * 1/1988 Ovitz, III ..... D6/672
4,722,473 A * 2/1988 Sandrini ..... B65D 11/1833 229/199
D294,908 S * 3/1988 Childress ..... D6/573
4,765,492 A * 8/1988 Howard ..... A47F 5/0025 211/55
4,793,664 A * 12/1988 Jackson ..... A47B 57/00 108/107
4,826,265 A * 5/1989 Hockenberry ..... A47B 96/021 292/148
4,836,379 A * 6/1989 Shaw ..... B65D 81/107 206/453
4,850,284 A * 7/1989 DeGroot ..... B65D 19/0012 108/56.3
4,852,756 A * 8/1989 Holladay ..... B65D 19/20 206/335
4,863,024 A * 9/1989 Booth ..... B65D 19/0016 206/386
4,871,067 A * 10/1989 Valenti ..... B65D 5/54 206/427
4,877,137 A * 10/1989 Govang ..... B65D 5/12 206/770
4,899,929 A * 2/1990 Grollman ..... B65D 5/36 221/302
4,911,084 A * 3/1990 Sato ..... B65D 19/44 108/55.3
4,911,311 A * 3/1990 Nagai ..... A47F 5/116 211/11
4,936,470 A * 6/1990 Prindle ..... A47J 47/16 D7/637
D321,100 S * 10/1991 Dorrell ..... D6/683.1
D321,295 S * 11/1991 Nuebler ..... D6/660
D321,615 S * 11/1991 Lavine ..... D6/675.3
5,067,418 A * 11/1991 Carter ..... B65D 19/0073 108/56.1
5,119,740 A * 6/1992 Carter ..... B65D 19/0073 108/56.3
5,125,520 A * 6/1992 Kawasaki ..... B62B 3/188 108/91
5,141,105 A * 8/1992 Maye ..... B65D 5/4204 211/135
5,176,265 A * 1/1993 Bennett ..... A47F 7/28 137/376
D332,883 S * 2/1993 Staude ..... D6/675.3

(56) References Cited

U.S. PATENT DOCUMENTS 5,183,166 A * 2/1993 Belokin, Jr. ..... A47F 5/116 211/130.1
5,193,466 A * 3/1993 Eder ..... A47F 5/116 108/166
5,195,440 A * 3/1993 Gottlieb ..... B65D 19/0026 108/56.3
5,213,220 A * 5/1993 McBride ..... A47B 55/06 211/132.1
5,259,631 A * 11/1993 Brande ..... A45C 11/00 229/120.19
5,269,219 A * 12/1993 Juvik-Woods ..... B65D 19/0016 108/56.3
5,272,990 A * 12/1993 Carter ..... B65D 19/0075 108/56.3
5,315,936 A * 5/1994 Smith ..... A47F 5/116 108/165
D349,202 S * 8/1994 Eliadis ..... D6/672
5,335,593 A * 8/1994 Stoddard ..... A47F 5/116 100/165
D351,076 S * 10/1994 Eliadis ..... D6/683.1
5,357,875 A * 10/1994 Winebarger ..... B65D 19/0024 108/51.3
5,388,531 A * 2/1995 Crews ..... B65D 19/0012 108/56.3
5,413,053 A * 5/1995 Vannatta ..... B65D 19/0012 108/56.3
5,427,019 A * 6/1995 Moorman ..... B65D 19/0026 108/56.1
5,443,168 A * 8/1995 Dyment ..... A47F 5/116 211/186
D362,768 S * 10/1995 Lechleiter ..... D6/683.1
5,458,411 A * 10/1995 Moss ..... A47B 47/06 312/259
D363,840 S * 11/1995 Weshler ..... D6/683.1
5,465,672 A * 11/1995 Boyse ..... B65D 19/0012 108/56.1
5,465,851 A * 11/1995 Smith ..... A47F 5/11 108/162
5,487,344 A * 1/1996 Hutchison ..... B65D 19/0073 108/56.1
5,487,345 A * 1/1996 Winebarger ..... B65D 19/0024 108/56.1
D369,035 S * 4/1996 Potter ..... D6/682.6
D369,043 S * 4/1996 Parker ..... D6/683.1
5,520,120 A * 5/1996 Badger ..... B65D 19/0028 108/56.3
5,528,994 A * 6/1996 Iseli ..... B65D 19/0026 108/51.3
5,540,536 A * 7/1996 Hoedl ..... B65D 21/00 414/811
5,543,205 A * 8/1996 Liebel ..... B31D 3/005 428/184
5,603,258 A * 2/1997 Besaw ..... B65D 19/0012 156/233
5,622,306 A * 4/1997 Grigsby, Sr. ..... B65D 15/22 217/65
5,630,518 A * 5/1997 Collins ..... A47F 5/112 211/132.1
5,669,683 A * 9/1997 Moss ..... A47B 47/06 312/259
5,672,412 A * 9/1997 Phares ..... B32B 3/266 428/184
5,678,492 A * 10/1997 Pinkstone ..... A47B 43/02 108/165
5,685,234 A * 11/1997 Grigsby ..... B65D 65/403 108/56.1
D388,905 S * 1/1998 Wells ..... D28/73
5,706,953 A * 1/1998 Polvere ..... A47F 5/116 206/756
5,706,959 A * 1/1998 Smith ..... A47F 5/0018 108/165
5,711,423 A * 1/1998 Fuller, Jr. ..... A24F 15/18 220/546
D395,534 S * 6/1998 Besaw ..... D34/38
5,758,783 A * 6/1998 Maglione ..... A47B 87/0207 211/126.2
5,762,213 A * 6/1998 Heneveld, Sr. ..... A47B 88/402 211/187
5,791,487 A * 8/1998 Dixon ..... B65D 5/5016 206/769
5,794,542 A * 8/1998 Besaw ..... B65D 19/20 108/56.1
5,797,499 A * 8/1998 Pinco ..... A47F 7/30 211/175
D398,461 S * 9/1998 Baluk ..... D6/683.1
D398,462 S * 9/1998 Baluk ..... D6/683.1
5,809,903 A * 9/1998 Young, Jr. ..... B65D 19/40 108/56.3
5,816,172 A * 10/1998 Carter ..... B65D 19/0095 108/56.1
5,826,732 A * 10/1998 Ragsdale ..... A47F 5/116 108/165
5,881,652 A * 3/1999 Besaw ..... B65D 19/20 108/51.3
D412,253 S * 7/1999 Brozak, Jr. ..... D6/683.1
5,918,744 A * 7/1999 Bringard ..... B65D 19/20 206/596
5,950,914 A * 9/1999 Dunton ..... B65D 5/5405 229/164
5,980,008 A * 11/1999 Stoever ..... B60B 33/0002 312/351.12
5,996,366 A * 12/1999 Renard ..... A47F 3/04 62/298
5,996,510 A * 12/1999 Harpman ..... B65D 19/0012 108/51.3
D419,275 S * 1/2000 Carter ..... D34/38
D419,744 S * 1/2000 Carter ..... D34/38
6,012,399 A * 1/2000 Carter ..... B65D 19/0097 108/57.22
6,070,726 A * 6/2000 Graham ..... B65D 19/0012 206/386
6,076,475 A * 6/2000 Kuhn ..... B65D 19/0012 108/51.3
D428,738 S * 8/2000 Brozak, Jr. ..... D6/678.3
6,098,820 A * 8/2000 Smith ..... A47F 5/116 211/132.1
6,126,131 A * 10/2000 Tietz ..... B25H 3/00 108/55.3
6,126,254 A * 10/2000 Maglione ..... A47F 5/116 312/259
6,135,030 A * 10/2000 Besaw ..... B65D 19/0012 108/51.3
D433,782 S * 11/2000 Carter ..... D34/38
D433,839 S * 11/2000 Culbertson ..... D28/73
6,145,671 A * 11/2000 Riga ..... A47F 7/30 40/538
6,145,794 A * 11/2000 Smith ..... A47F 5/108 248/459
6,164,215 A * 12/2000 Cook ..... A47B 96/04 211/184
6,189,778 B1 * 2/2001 Kanter ..... B65D 5/001 229/172
6,302,283 B1 * 10/2001 Yeh ..... A47F 5/116 211/186
D453,057 S * 1/2002 Sewell ..... D34/38
6,354,229 B1 * 3/2002 Heidtke ..... B65D 19/0012 108/51.3
6,357,587 B1 * 3/2002 Melms, Jr. ..... B65D 85/64 206/326
6,360,465 B1 * 3/2002 Simpson ..... G09F 3/204 40/661.03
6,394,003 B1 * 5/2002 Lacy, III ..... B65D 19/02 108/51.3
6,394,290 B1 * 5/2002 Walsh ..... A47F 5/114 108/162
D461,334 S * 8/2002 Johnson ..... D6/705
D464,498 S * 10/2002 Riga ..... D6/699

(56) References Cited

U.S. PATENT DOCUMENTS 6,510,982 B2 * 1/2003 White ..... B65D 5/5445 229/164
6,585,118 B2 * 7/2003 Kellogg ..... A47F 3/004 211/85.16
6,612,247 B1 * 9/2003 Pistner ..... B65D 19/0012 108/51.3
6,612,669 B2 * 9/2003 Grueneberg ..... A47B 43/02 108/165
6,659,295 B1 * 12/2003 De Land ..... A47B 96/04 211/187
6,715,623 B2 * 4/2004 Broerman ..... A47F 5/116 211/149
6,729,484 B2 * 5/2004 Sparkowski ..... A47F 5/137 211/187
6,752,280 B2 * 6/2004 Dye ..... A47F 5/116 108/162
6,769,368 B2 * 8/2004 Underbrink ..... B65D 19/44 108/55.3
D495,901 S * 9/2004 Bosman ..... D6/675.1
6,814,245 B2 * 11/2004 Leclerc ..... A47B 47/021 211/187
6,902,074 B2 * 6/2005 Albrecht ..... A01K 63/006 312/257.1
6,905,021 B2 * 6/2005 Polumbaum ..... B65D 19/0018 206/451
D509,382 S * 9/2005 Raile ..... D6/675.3
6,951,300 B2 * 10/2005 Caille ..... B65D 5/5445 229/242
6,966,447 B2 * 11/2005 Hiltke ..... A47F 5/116 211/72
7,007,615 B2 * 3/2006 Grueneberg ..... A47F 5/116 108/165
D521,275 S * 5/2006 Dusenberry ..... D6/675.1
7,036,196 B2 * 5/2006 Salatin ..... A47F 5/0846 211/85.16
7,066,342 B2 * 6/2006 Baechle ..... B65D 21/0215 206/600
7,066,380 B2 * 6/2006 Blake ..... B65D 5/722 229/243
7,089,872 B2 * 8/2006 Wintermute, II ..... A47F 5/116 108/165
7,111,735 B2 * 9/2006 Lowry ..... B65D 5/52 206/766
7,137,517 B2 * 11/2006 Lowry ..... B65D 21/0215 229/199
D533,734 S * 12/2006 Campbell ..... D6/672
7,191,906 B1 * 3/2007 Pinco ..... G09F 5/00 211/85.27
7,252,200 B1 * 8/2007 Hester ..... A47F 5/116 211/187
D566,989 S * 4/2008 Mason ..... D6/680.2
D576,426 S * 9/2008 Yuen-Schat ..... D6/675.4
D578,804 S * 10/2008 Norman ..... D6/675.1
7,546,926 B2 * 6/2009 Stolle ..... A47F 7/00 211/10
7,546,927 B2 * 6/2009 Lowry ..... A47F 3/142 206/557
D603,189 S * 11/2009 Raile ..... D6/682.2
7,677,433 B2 * 3/2010 Little ..... B65D 5/526 229/120.31
7,703,665 B2 * 4/2010 McGowan ..... B65D 5/721 221/302
7,717,265 B2 * 5/2010 Honkawa ..... B65D 19/44 206/730
7,726,474 B2 * 6/2010 Berger ..... B65D 85/1036 206/268
7,828,169 B2 * 11/2010 Robinson ..... A47F 5/116 312/260
7,992,716 B2 * 8/2011 Jackson ..... B65D 5/48014 206/774
8,002,171 B2 * 8/2011 Ryan ..... B65D 5/606 229/122
8,141,713 B2 * 3/2012 Farkas ..... B65D 5/722 206/762
8,157,112 B2 * 4/2012 Bojie ..... A47F 5/11 211/72
9,045,250 B2 * 6/2015 Henderson ..... B65D 5/56
9,198,508 B1 * 12/2015 Kufel ..... A47B 47/024
9,211,021 B2 * 12/2015 Smith ..... A47F 5/116
9,428,298 B2 * 8/2016 Bersamin ..... B65D 5/006
9,487,321 B2 * 11/2016 Luke ..... A47F 5/116
9,743,783 B1 * 8/2017 Bersamin ..... A47F 5/116
9,907,414 B2 * 3/2018 Heuer ..... A47B 96/021
9,918,569 B1 * 3/2018 Abel ..... B65D 5/5213
9,919,829 B2 * 3/2018 Jolley ..... B65D 5/328
9,938,040 B2 * 4/2018 Buscema ..... B65D 5/02
9,969,523 B2 * 5/2018 Ayerst ..... B65D 5/5405
10,315,798 B2 * 6/2019 Pfeifer ..... B65D 19/0012
10,448,758 B1 * 10/2019 Abel ..... A47B 43/02
10,463,176 B1 * 11/2019 Sells ..... A47F 5/114
10,470,591 B1 * 11/2019 Heiden ..... A47F 5/116
10,524,588 B2 * 1/2020 Pratsch ..... A47B 43/02
10,524,589 B2 * 1/2020 Donegan ..... A47F 5/112
10,531,750 B1 * 1/2020 Heiden ..... A47F 5/0018
10,568,439 B2 * 2/2020 Bersamin ..... A47F 5/116
2002/0189507 A1 * 12/2002 Benner ..... B65D 19/0028 108/56.3
2003/0042828 A1 * 3/2003 Bonin ..... A47B 67/02 220/87.1
2003/0042829 A1 * 3/2003 Torres ..... E06B 7/34 312/321.5
2003/0111383 A1 * 6/2003 Qiu ..... B65D 81/054 206/586
2004/0195195 A1 * 10/2004 Mason ..... A47F 5/0018 211/186
2005/0252872 A1 * 11/2005 Eisele ..... A47B 57/42 211/187
2005/0274684 A1 * 12/2005 Swanson ..... A47B 49/00 211/78
2006/0006096 A1 * 1/2006 Funk ..... B65D 5/48014 206/746
2006/0283775 A1 * 12/2006 Mark ..... B65D 25/28 206/774
2007/0193479 A1 * 8/2007 Slaats ..... A47F 5/0018 206/386
2007/0272639 A1 * 11/2007 Alexander ..... A47F 5/10 211/186
2008/0169339 A1 * 7/2008 Moser ..... B65D 5/5213 229/108.1
2008/0169340 A1 * 7/2008 Sheffer ..... A47F 5/116 229/120.32
2008/0173602 A1 * 7/2008 Field ..... A47F 5/116 211/149
2008/0265726 A1 * 10/2008 Sheffer ..... A47B 47/06 493/56
2009/0107940 A1 * 4/2009 Norman ..... A47F 5/0815 211/153
2009/0127150 A1 * 5/2009 Meers ..... B65D 25/38 206/499
2010/0006529 A1 * 1/2010 Groff ..... A47F 5/116 211/186
2010/0025344 A1 * 2/2010 Virvo ..... A47F 5/116 211/59.2
2010/0133215 A1 * 6/2010 Norman ..... A47F 5/108 220/1.5
2011/0000955 A1 * 1/2011 Manteufel ..... B65D 5/728 229/103
2011/0049072 A1 * 3/2011 Dewhurst ..... A47F 5/0018 211/153
2011/0266177 A1 * 11/2011 Lowry ..... B65D 19/44 53/399
2012/0074037 A1 * 3/2012 Orischak ..... B65D 5/5405 206/736
2012/0305512 A1 * 12/2012 L'Hotel ..... A47F 5/116 211/198
2013/0097903 A1 * 4/2013 Gerstner ..... G09F 27/005 40/606.03
2013/0213915 A1 * 8/2013 Pfeifer ..... A47F 5/116 211/195

(56) References Cited

U.S. PATENT DOCUMENTS

| | | | | |
|---|---|---|---|---|
| 2013/0270133 | A1* | 10/2013 | Kenner | B65D 5/4266 206/320 |
| 2014/0217047 | A1* | 8/2014 | Frost | B65H 45/12 211/186 |
| 2015/0041420 | A1* | 2/2015 | Zelek | A47F 5/10 211/195 |
| 2015/0136720 | A1* | 5/2015 | Miller | A47F 5/101 29/466 |
| 2016/0066711 | A1* | 3/2016 | Mestres Armengol | A47F 5/112 211/195 |
| 2016/0198870 | A1* | 7/2016 | Volz | A47F 5/116 211/135 |
| 2017/0079449 | A1* | 3/2017 | Smith | A47B 43/02 |
| 2017/0295927 | A1* | 10/2017 | Gibbons, Jr. | A47F 5/116 |
| 2018/0042405 | A1* | 2/2018 | Lilja | B65D 5/5273 |
| 2018/0092461 | A1* | 4/2018 | Brady | A47B 55/06 |
| 2018/0130382 | A1* | 5/2018 | Hinch | G09F 1/065 |
| 2018/0146803 | A1* | 5/2018 | Urban | B65D 5/0218 |
| 2018/0160825 | A1* | 6/2018 | Abel | B65D 5/5213 |
| 2018/0289178 | A1* | 10/2018 | McMillan-Sweat | A47F 5/116 |
| 2019/0008290 | A1* | 1/2019 | Ertl | B65D 21/086 |
| 2019/0150611 | A1* | 5/2019 | Burnett | A47B 7/00 |
| 2019/0380513 | A1* | 12/2019 | Frost | A47F 5/112 |
| 2020/0037787 | A1* | 2/2020 | Pratsch | A47F 5/114 |
| 2020/0113355 | A1* | 4/2020 | Hara | A47F 5/116 |
| 2020/0288881 | A1* | 9/2020 | Burgert | A47F 5/116 |
| 2020/0297132 | A1* | 9/2020 | Nguyen | A47F 5/0018 |
| 2020/0375375 | A1* | 12/2020 | Robinson | A47B 55/06 |

* cited by examiner

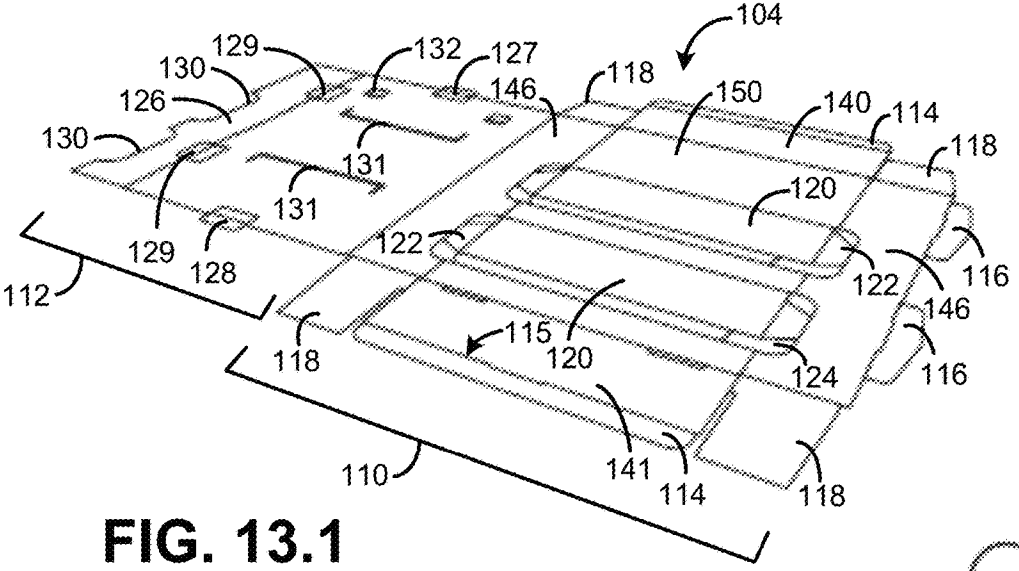
FIG. 13.1
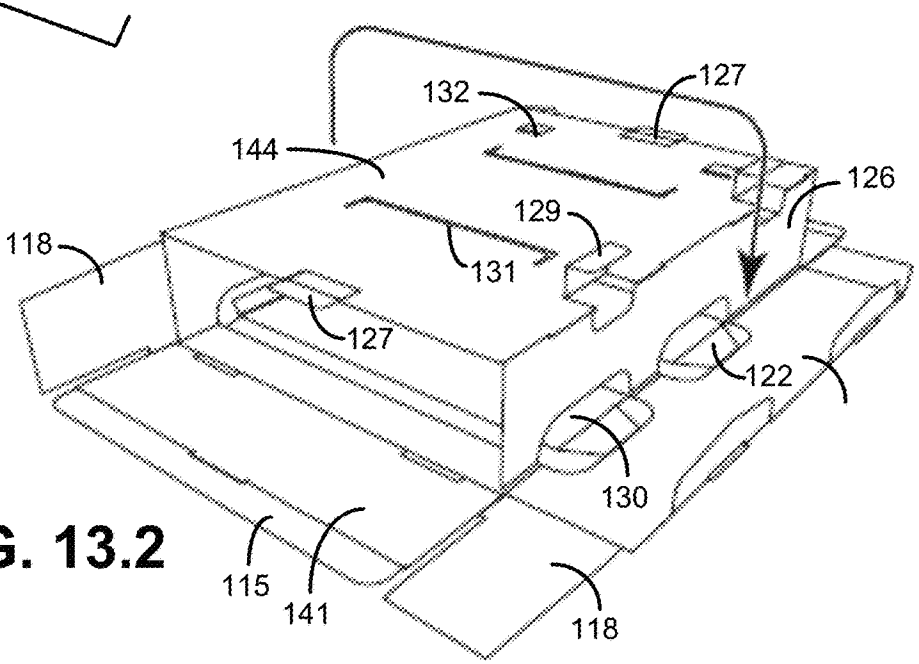
FIG. 13.2

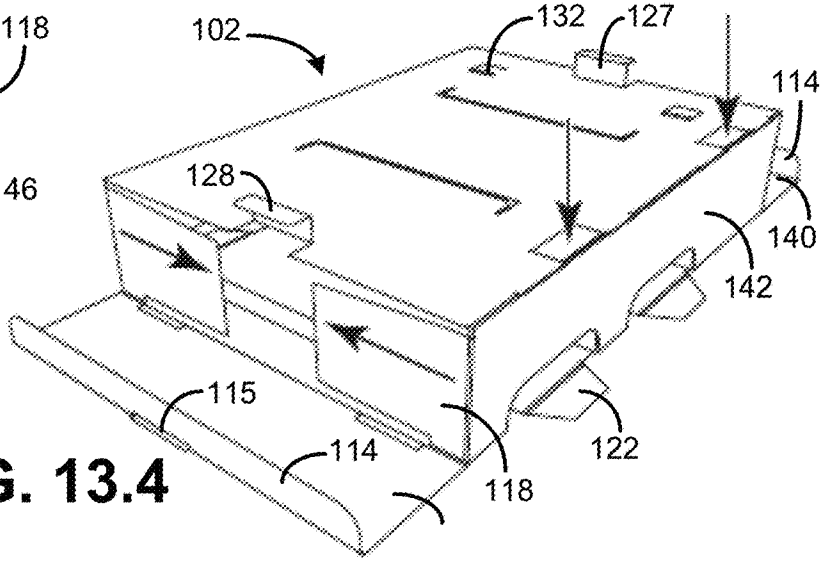
FIG. 13.4
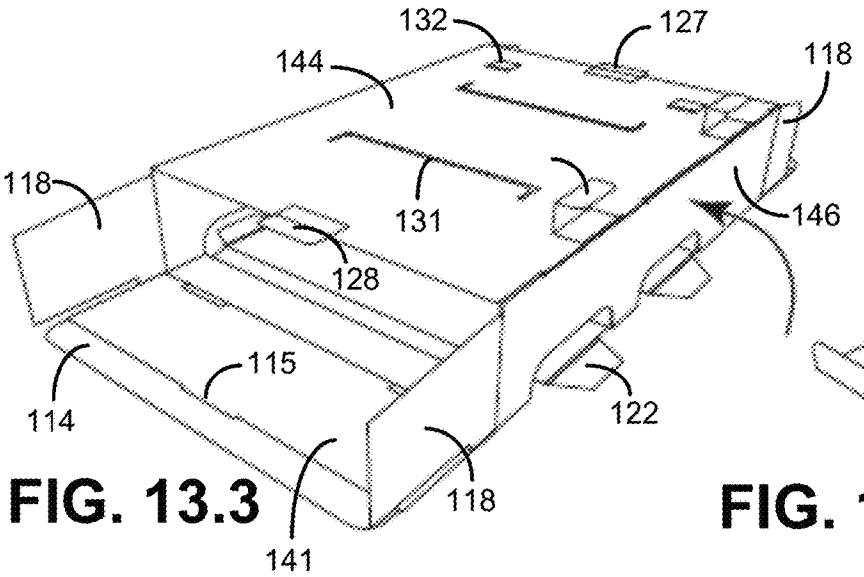
FIG. 13.3
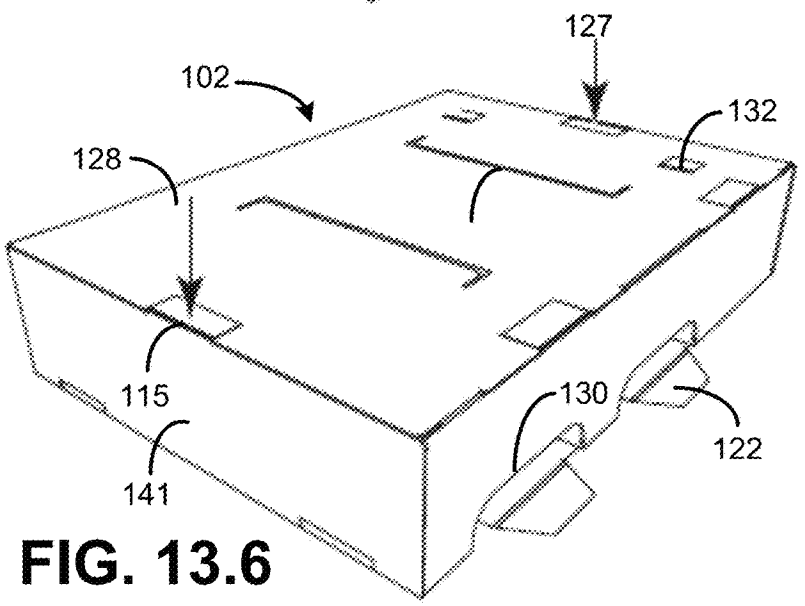
FIG. 13.6
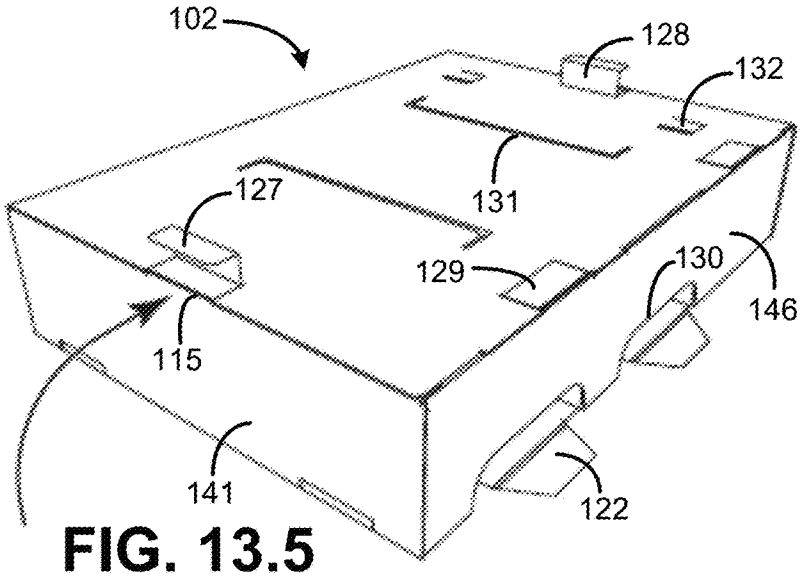
FIG. 13.5

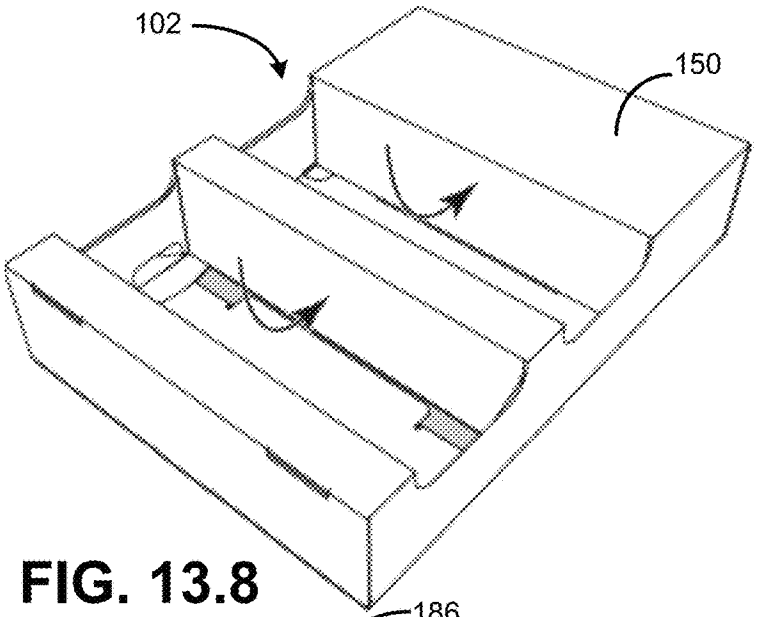
FIG. 13.8
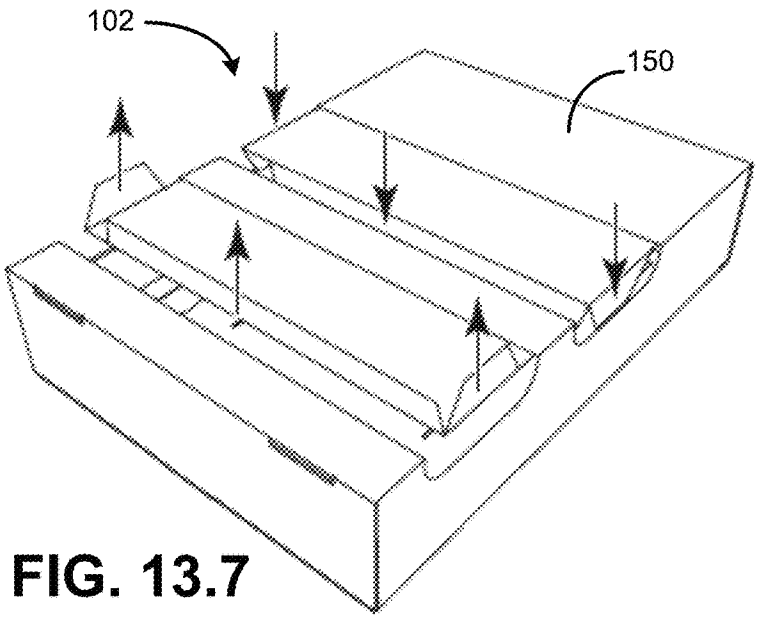
FIG. 13.7
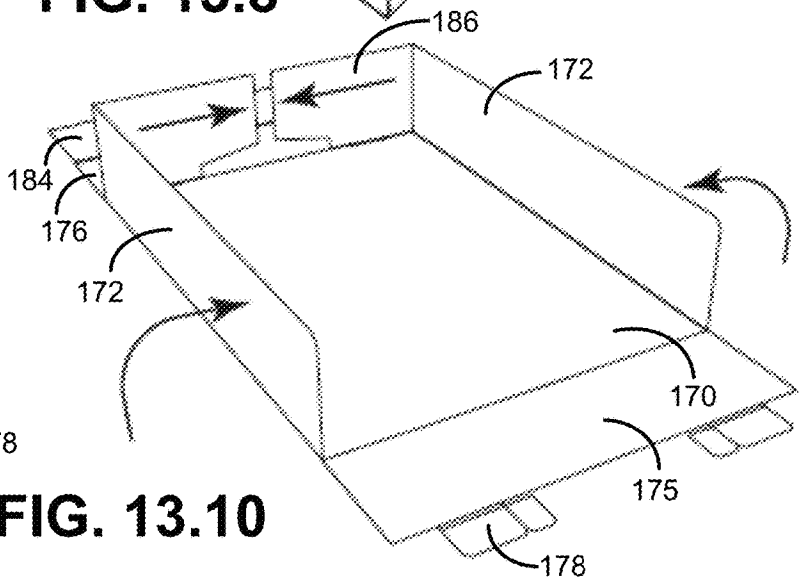
FIG. 13.10
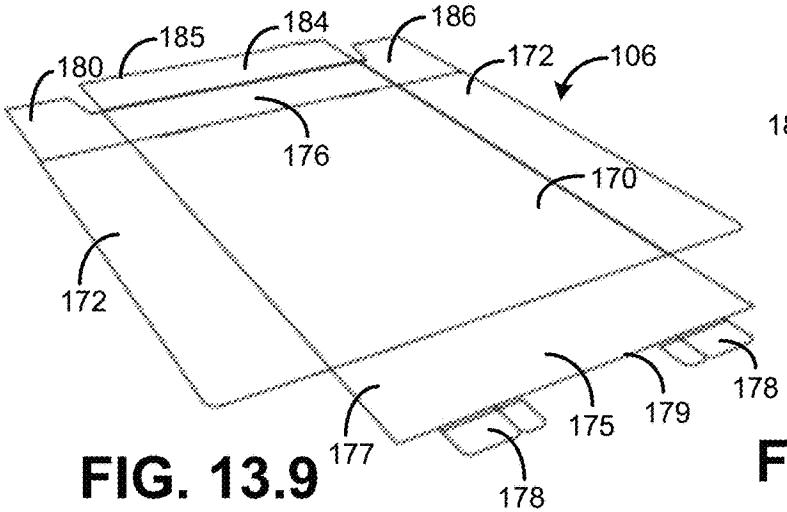
FIG. 13.9

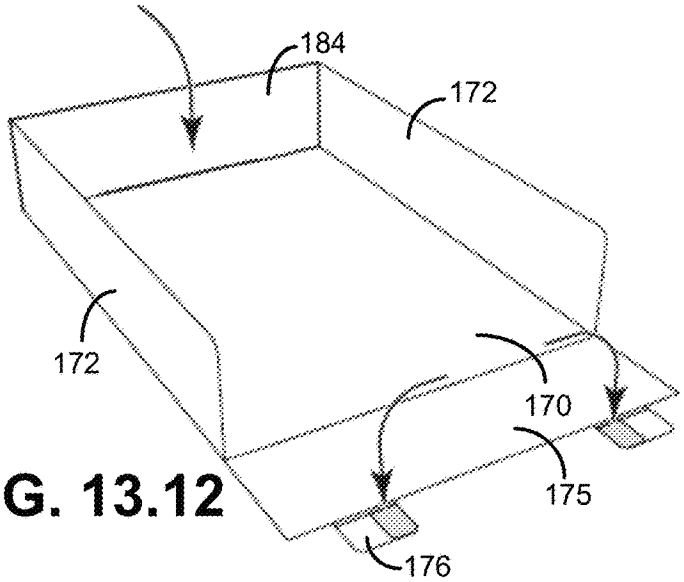
FIG. 13.12
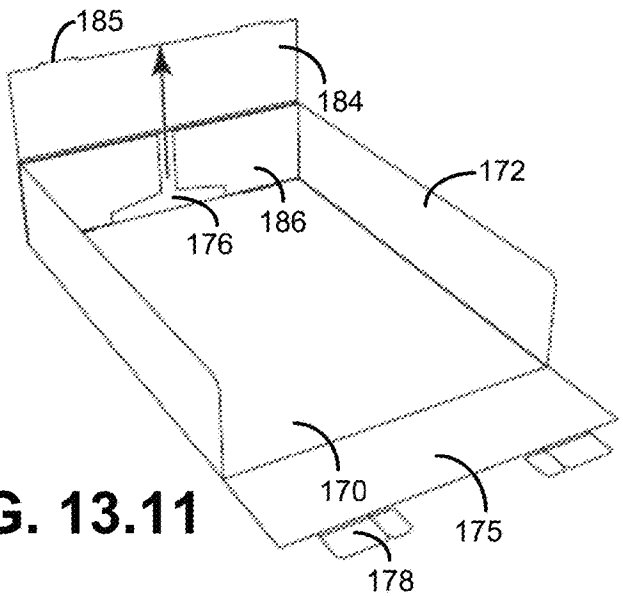
FIG. 13.11
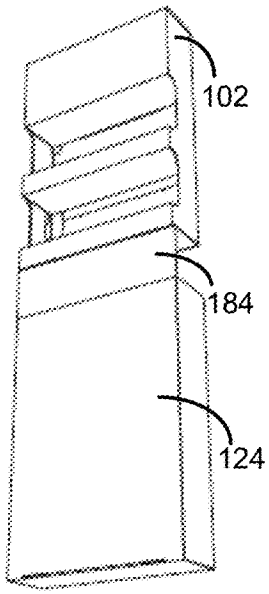
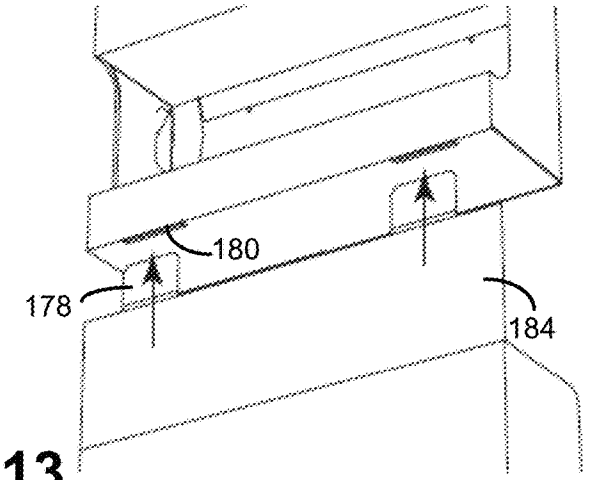
FIG. 13.13

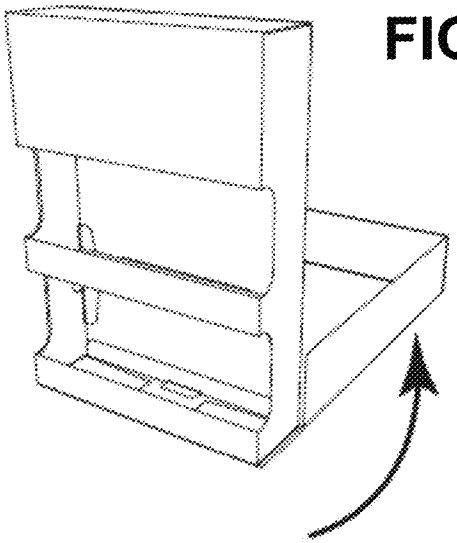
FIG. 13.14
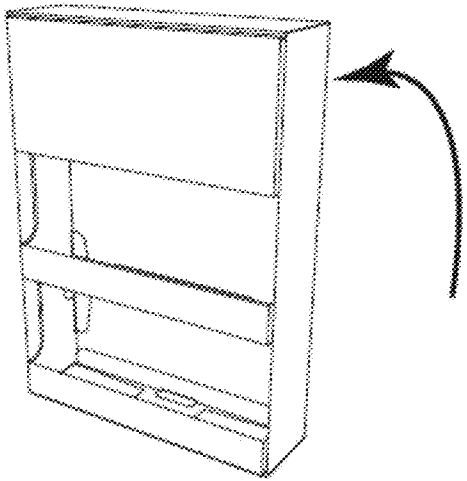
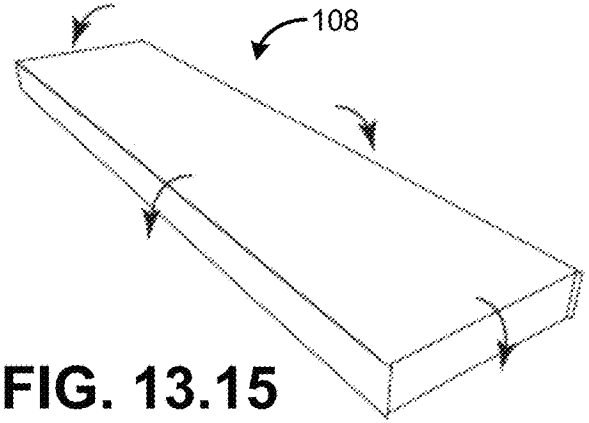
FIG. 13.15
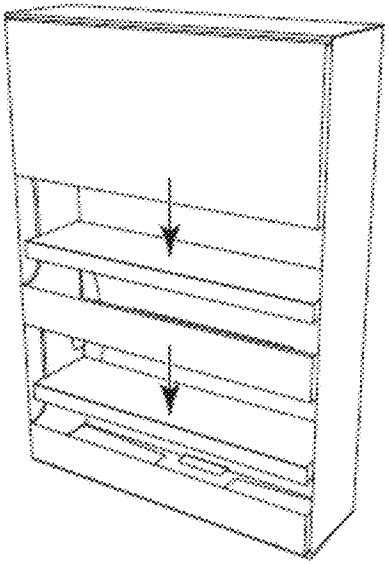
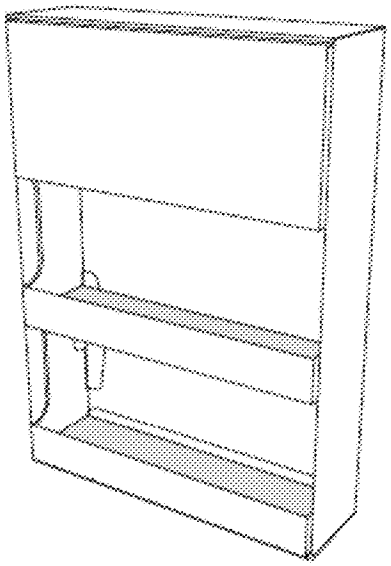
FIG. 13.16

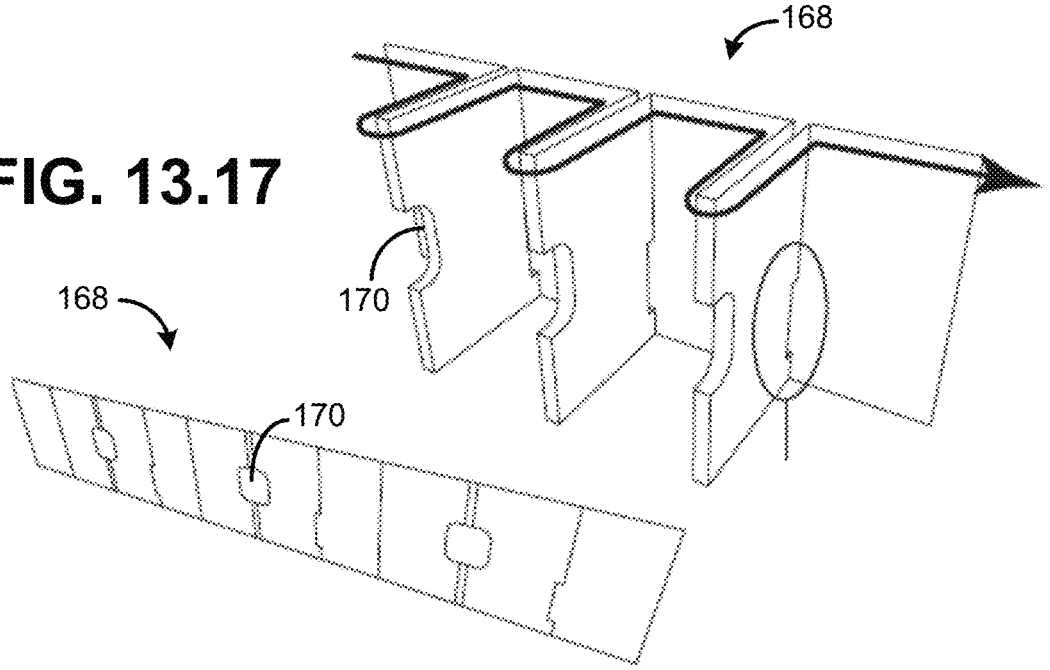
FIG. 13.17
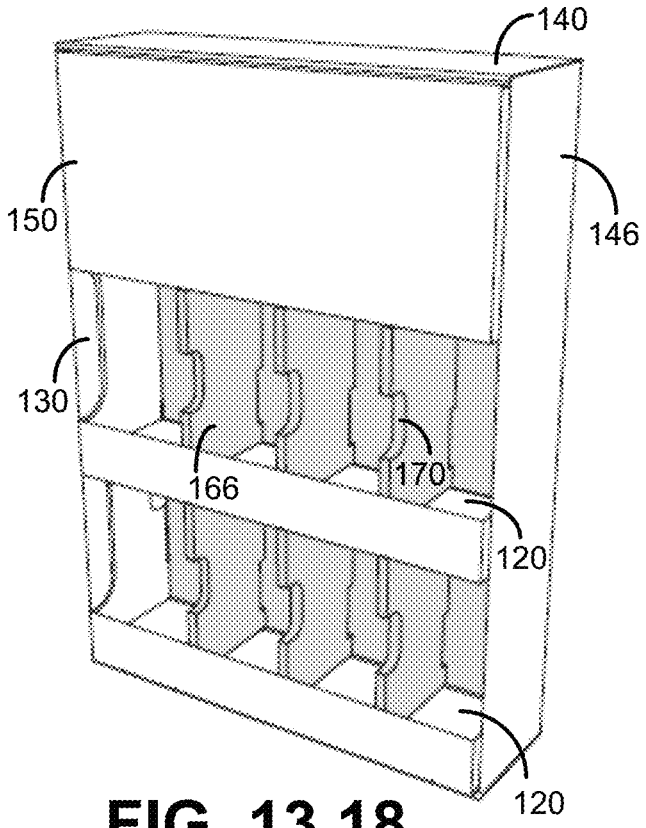
FIG. 13.18

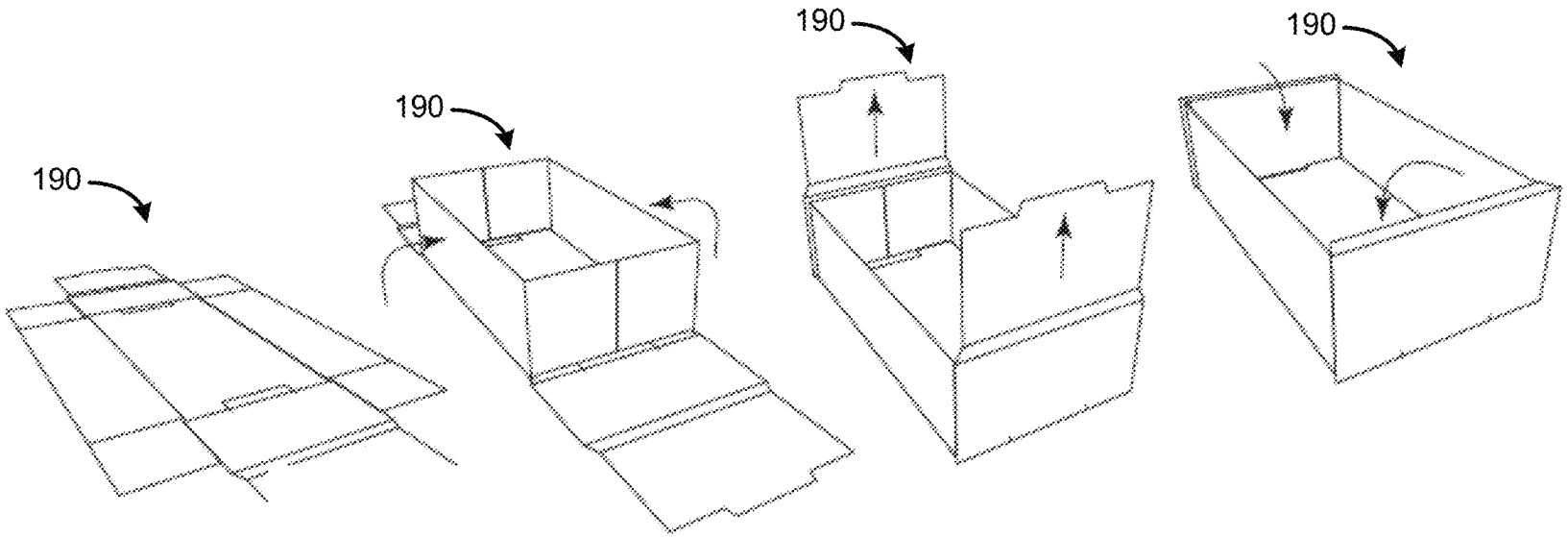
FIG. 13.19

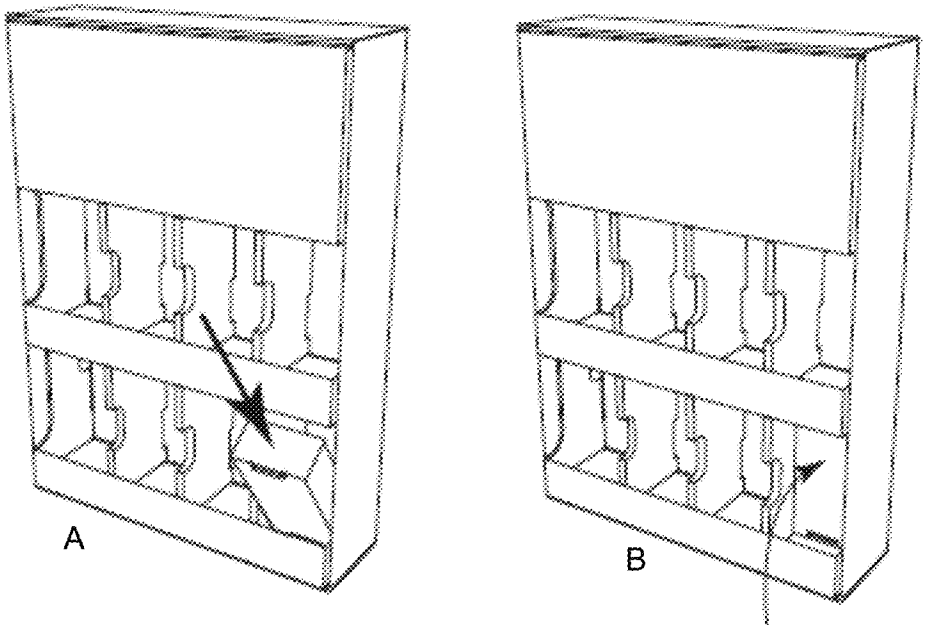
FIG. 13.21
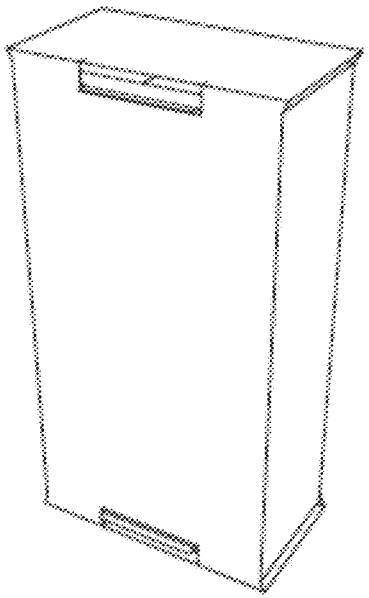
FIG. 13.20

FIG. 21.1
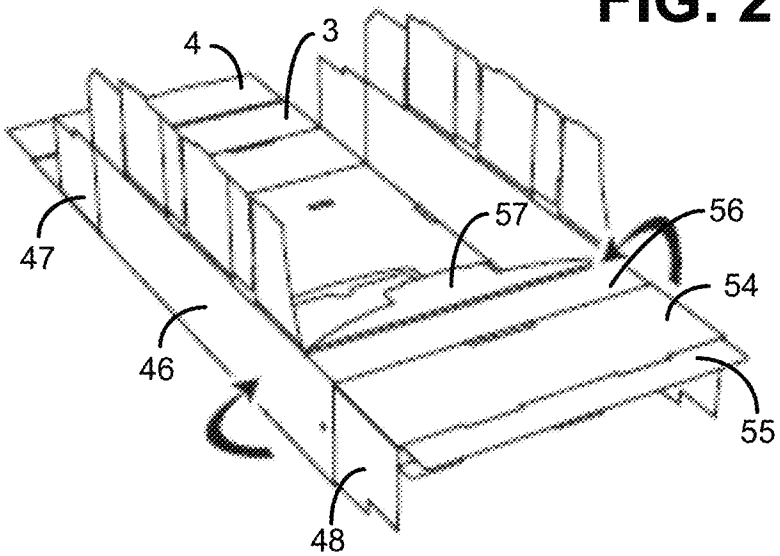
FIG. 21.2
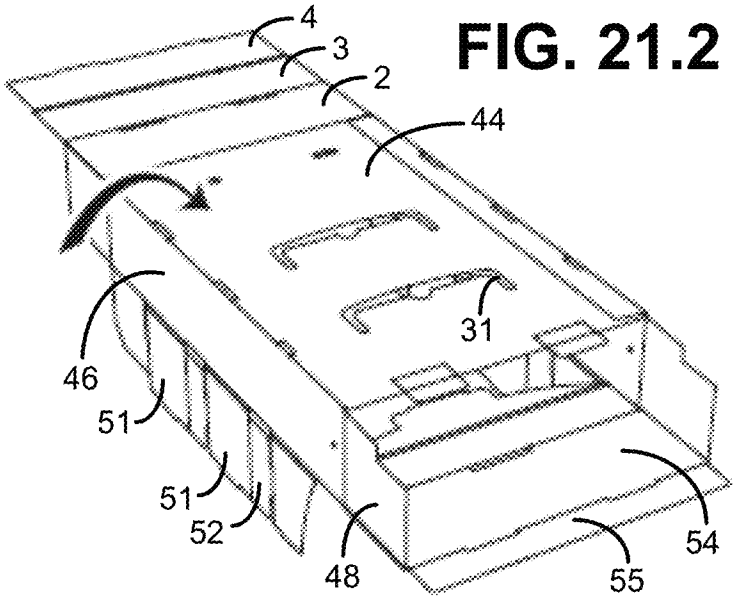

FIG. 21.3
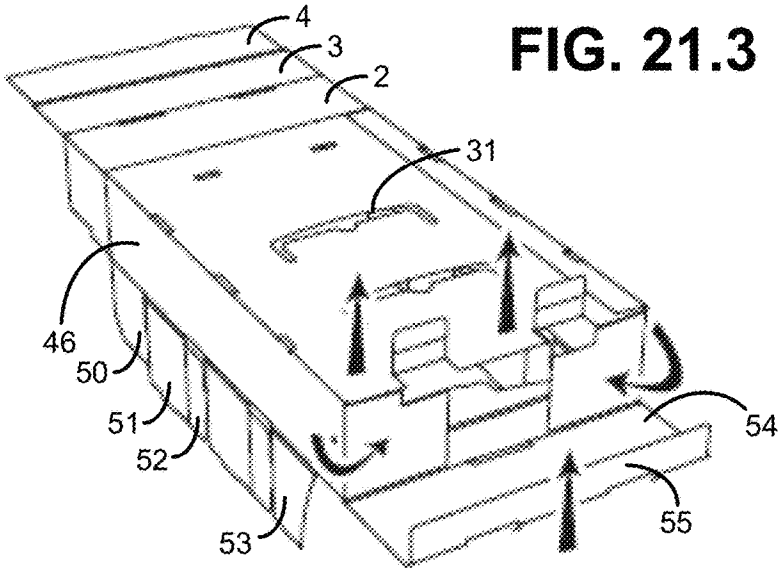
FIG. 21.4
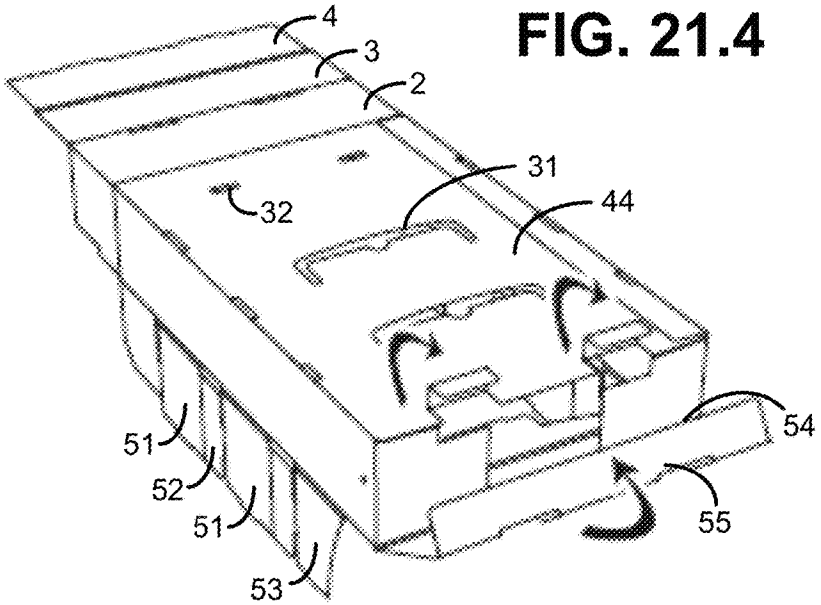

FIG. 21.5
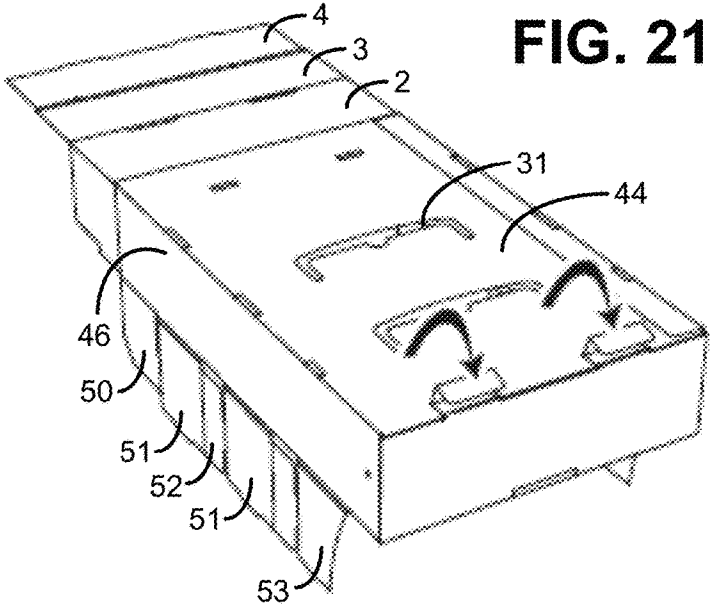
FIG. 21.6
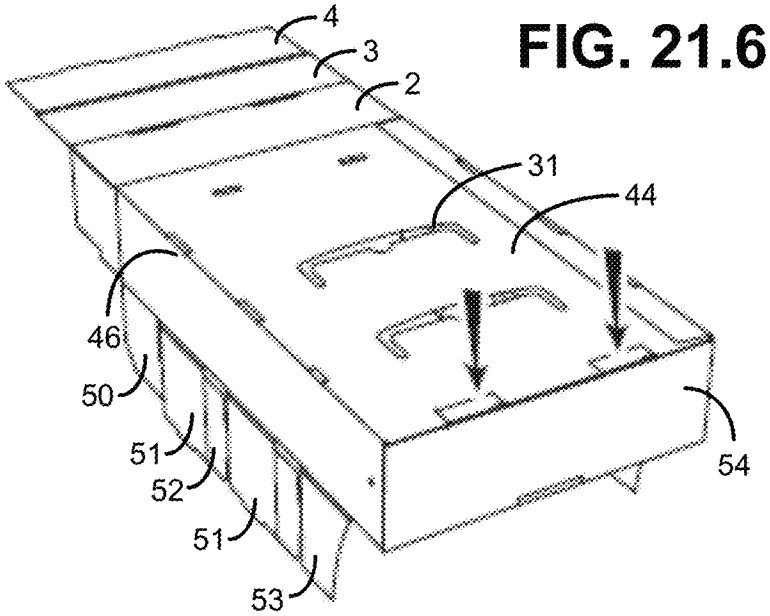

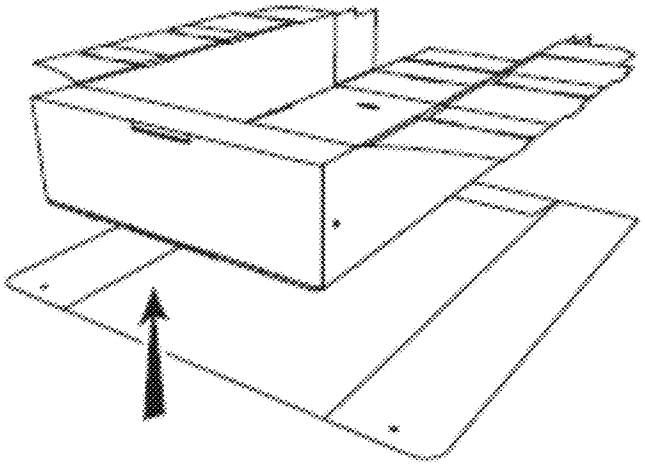
FIG. 21.8
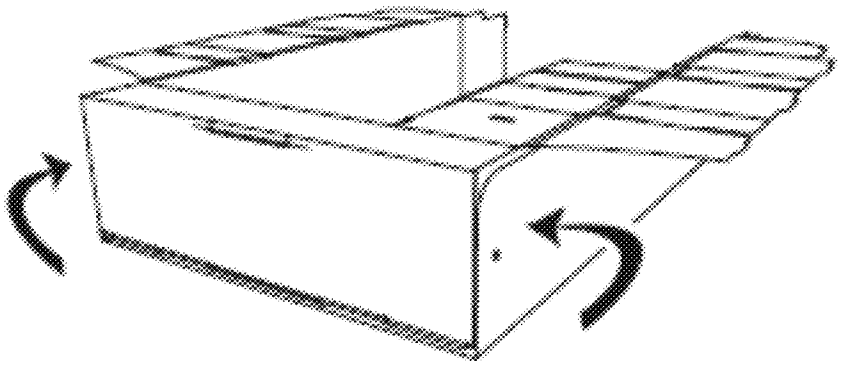
FIG. 21.9
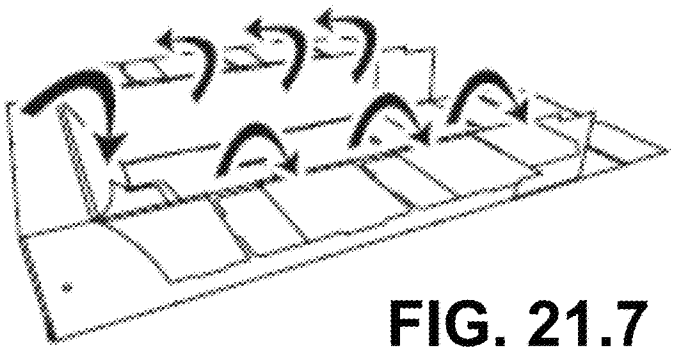
FIG. 21.7

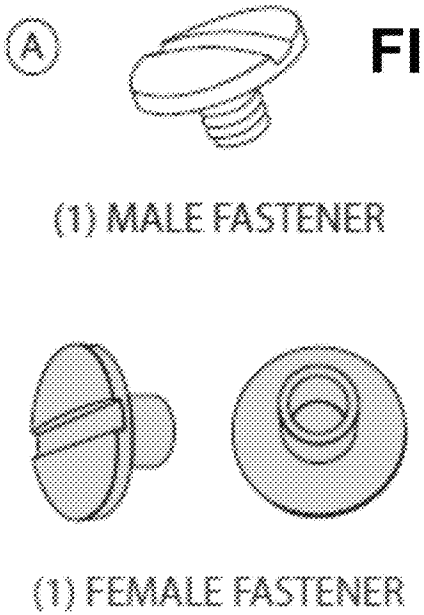
FIG. 21.10
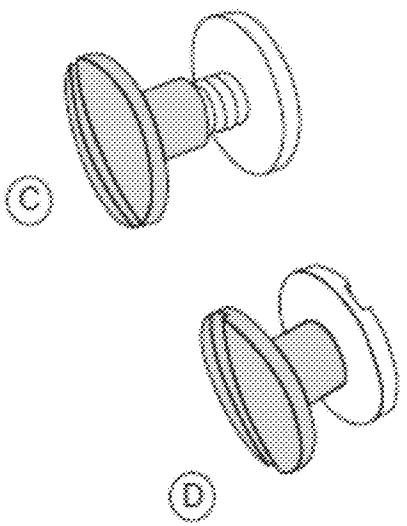
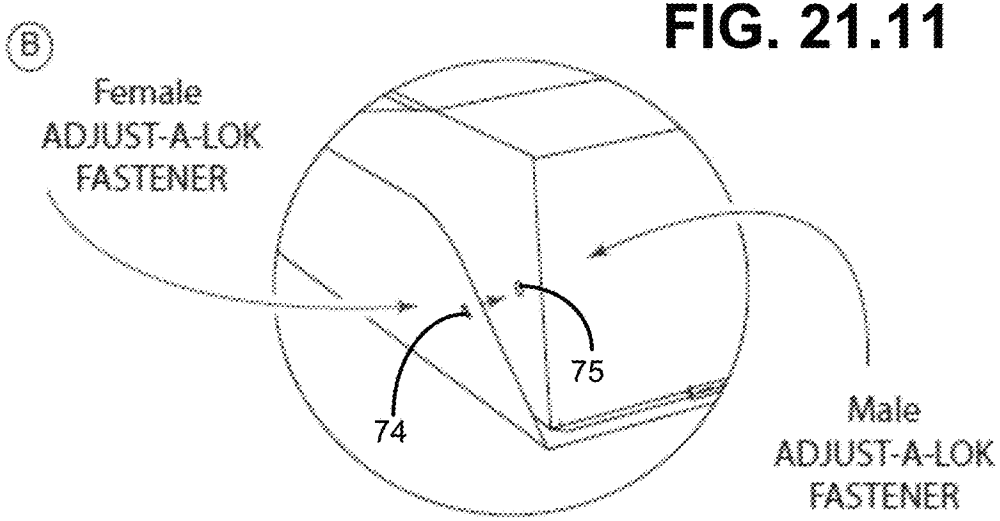
FIG. 21.11

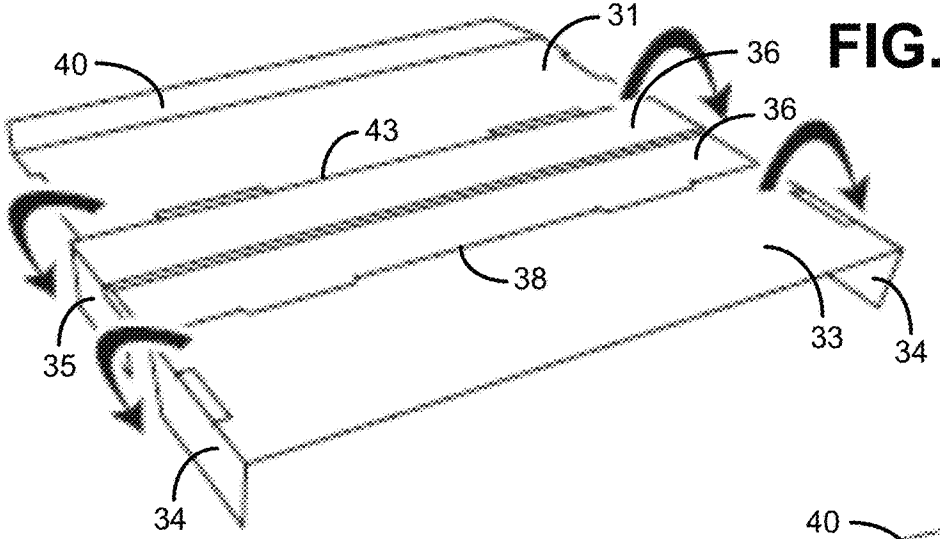
FIG. 21.12
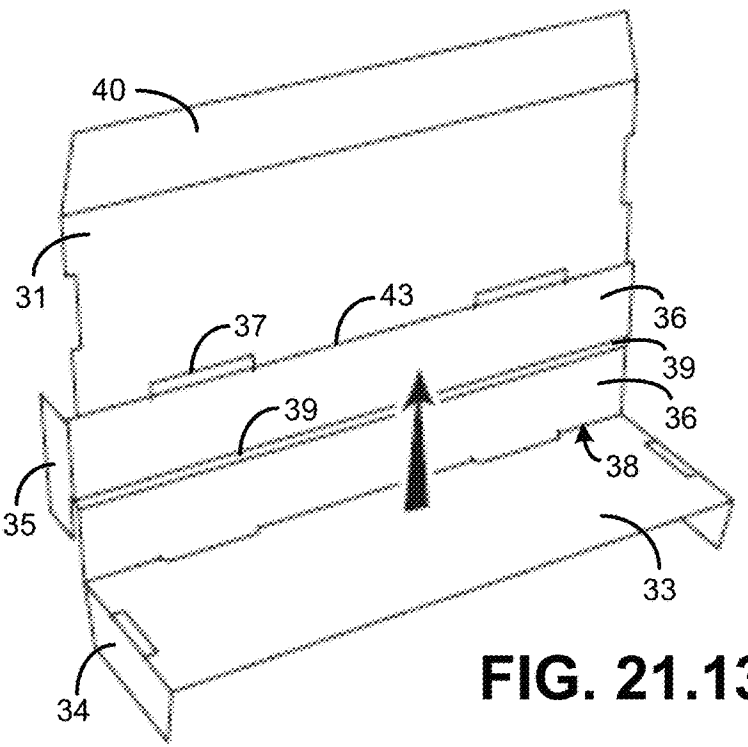
FIG. 21.13

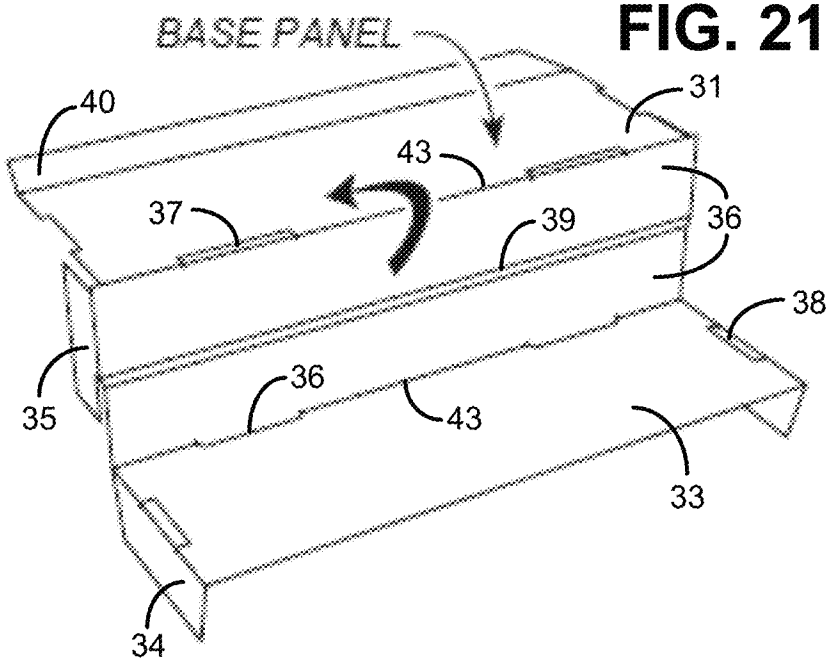
FIG. 21.14
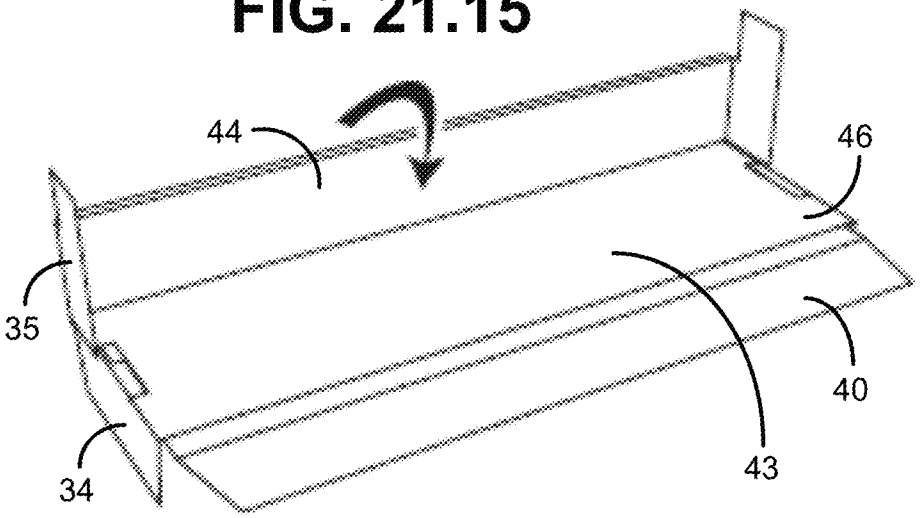
FIG. 21.15

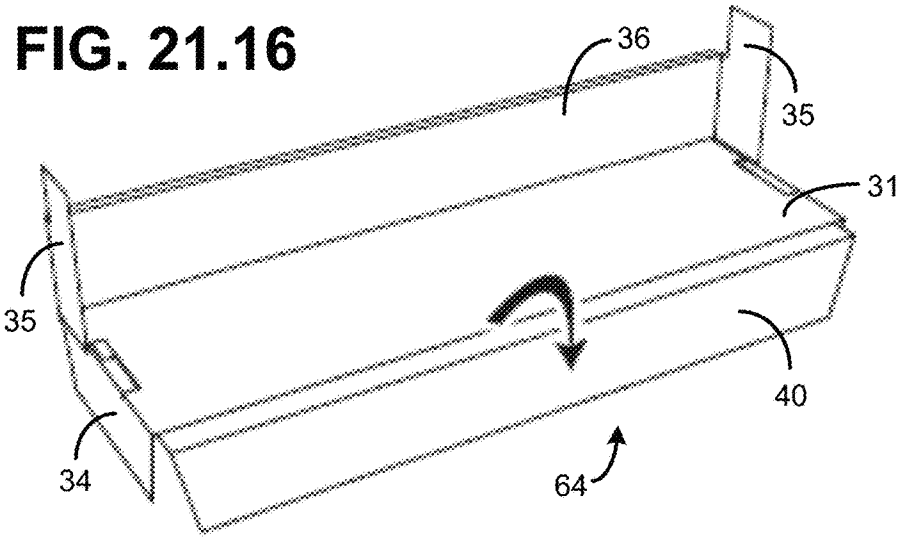
FIG. 21.16
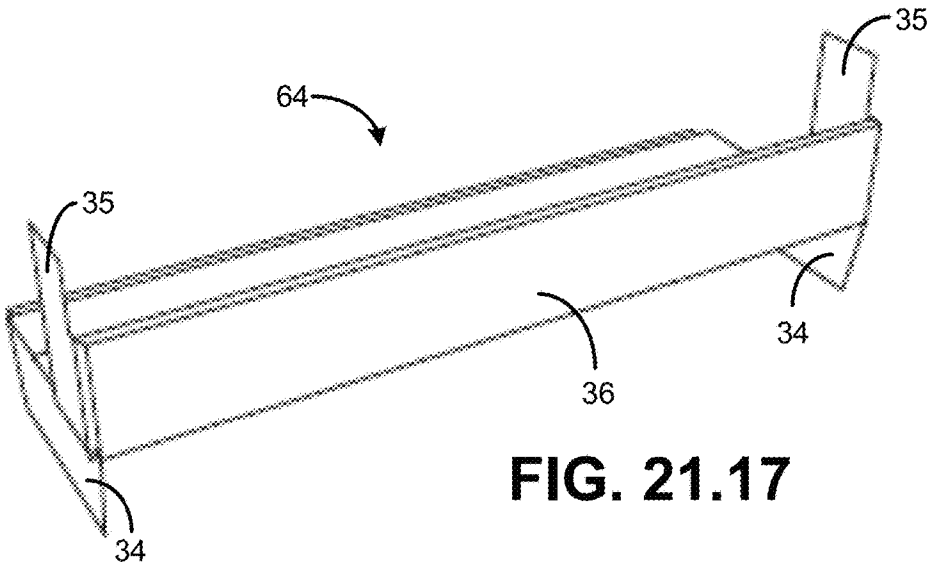
FIG. 21.17

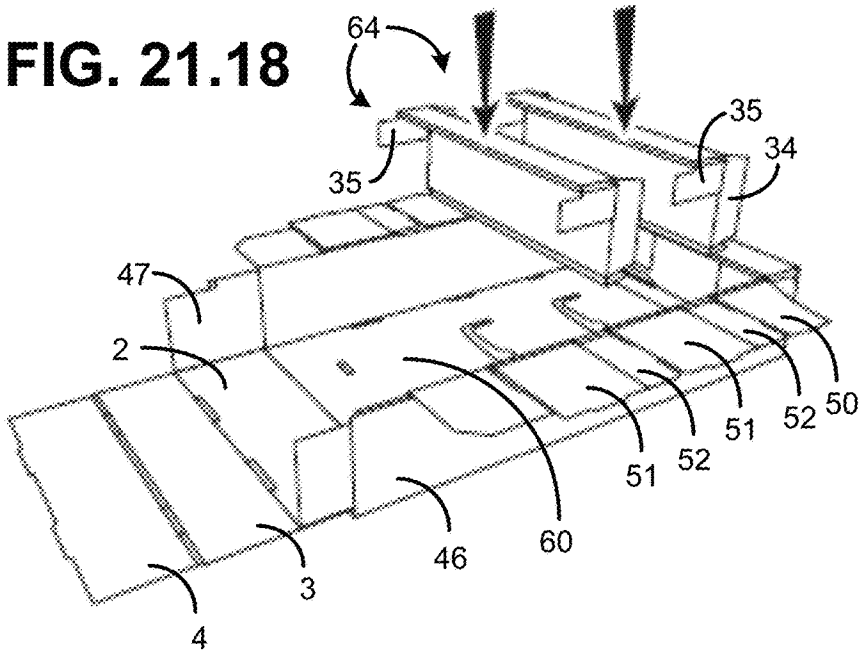
FIG. 21.18
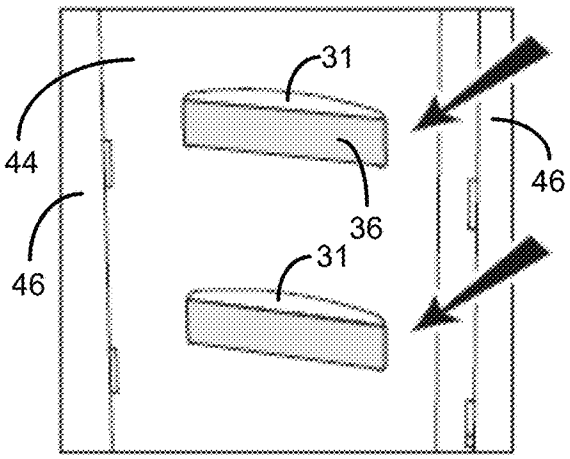
FIG. 21.20
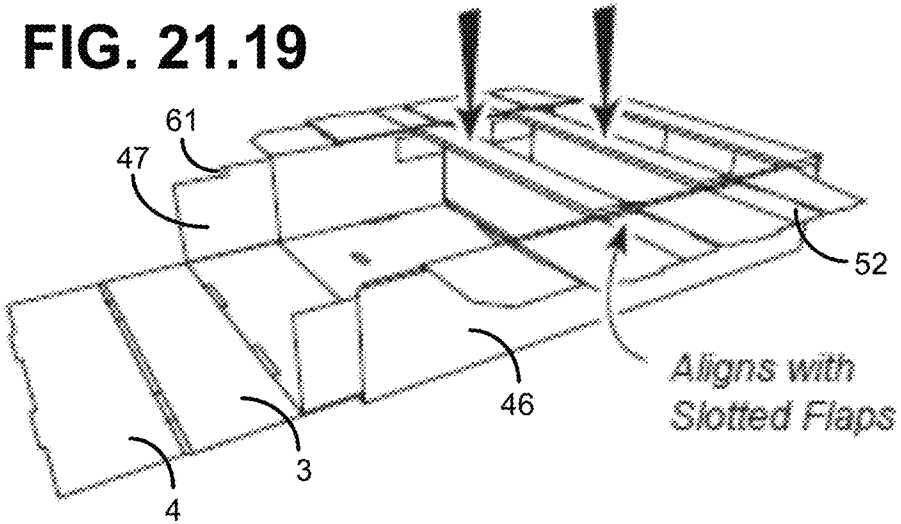
FIG. 21.19

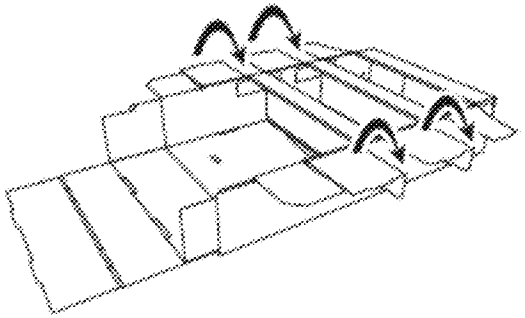
FIG. 21.21
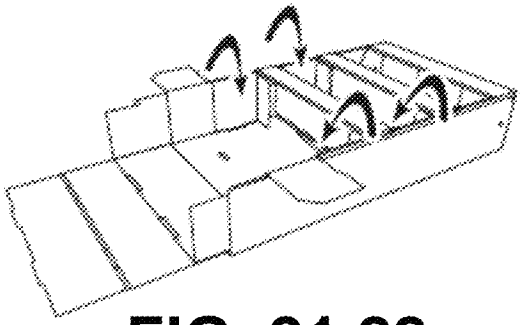
FIG. 21.22
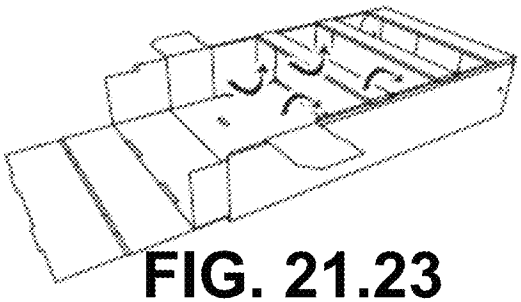
FIG. 21.23
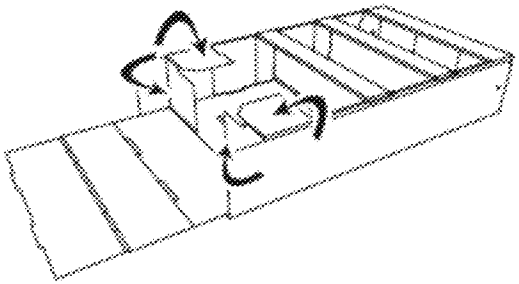
FIG. 21.24
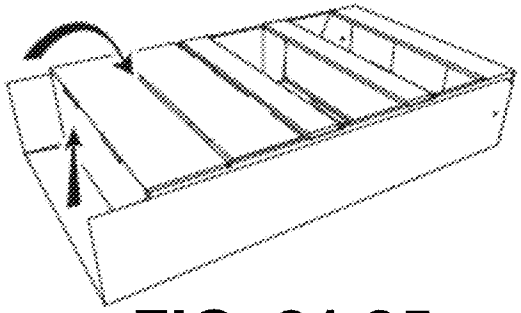
FIG. 21.25
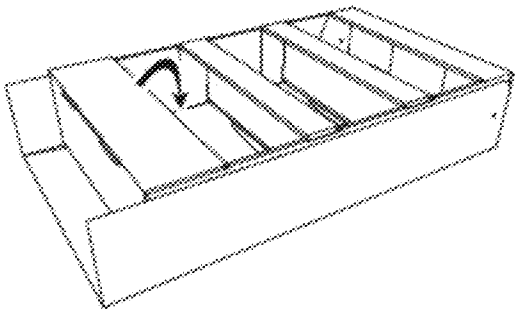
FIG. 21.26

FULL WING DISPLAY

CROSS-REFERENCE TO RELATED APPLICATIONS

The present invention is a continuation of U.S. patent application Ser. No. 17/235,331, filed Apr. 20, 2021, which is a continuation of U.S. patent application Ser. No. 16/819,528, filed Mar. 16, 2020, now U.S. Pat. No. 11,019,943, which claims priority to and the benefit of U.S. Provisional Patent Application No. 62/819,118 filed Mar. 15, 2019, the contents of which are incorporated herein by reference and made a part hereof.

FEDERALLY SPONSORED RESEARCH OR DEVELOPMENT

N/A

FIELD OF THE INVENTION

Corrugated paperboard displays for holding, retaining, and the controlled dispensing of packaged goods in a retail sales environment.

DESCRIPTION OF THE PRIOR ART

Paperboard displays are widely used to display products for sale in a retail environment. Many such displays are dedicated to holding and supporting product and leave little room for textual and graphical information about the product. The present invention is directed to a display that provides a large surface area of print space when in a deployed condition but much less surface area when in a stowed condition.

SUMMARY OF THE INVENTION

A corrugated paper display moveable from a stowed condition to a display condition is described herein. The corrugated paper display has a first rectangular sleeve folded from a first blank of corrugated paper having a back wall panel, a front wall panel, a top surface panel, and two opposed side wall panels. Each of the side wall panels having a first lateral edge and a second lateral edge opposed to the first lateral edge. The first lateral edge is connected respectively to opposed lateral edges of the back wall. The second lateral edge is connected to a segmented shelf support panel. The segmented shelf support panel has a pair of shelf support flaps separated by a gap. The shelf support flaps are hingedly connected to the shelf support panel and are folded 180° downward in contact with an inner surface of the side wall from which it depends to support a shelf. A shelf is positioned in the gap and is folded from a second blank of corrugated paper. The shelf is supported at opposed ends by the shelf support flaps when the display is in the deployed condition. The display has a third panel folded from a third blank of corrugated material and has a front panel and two side panels extending from opposed lateral edges of the front panel and extending orthogonally therefrom. When in the stowed condition, a first planar surface of the front panel is in contact with a portion of the first rectangular sleeve and is stacked on top thereof to form a body having a first height. When in the deployed condition, the third panel is hingedly connected to the first rectangular sleeve to form a body of a second height which is 1.5 to 2.5 times greater than the first height. A hinge connects the third panel to the first rectangular sleeve to allow movement from the stowed condition to the deployed condition.

Also disclosed is a corrugated paper display moveable from a stowed condition to a deployed condition. The display has a back wall panel, a front wall panel, a top surface panel, and two opposed side wall panels. Each of the two opposed side walls have a first lateral edge and a second lateral edge opposed to the first lateral edge. The first lateral edge is connected respectively to opposed lateral edges of the back wall. The second lateral edge is connected to a segmented shelf support panel. The segmented shelf support panel has a pair of a shelf support flap and a gap in vertical spaced relationship when the display is in the deployed condition. The shelf support flaps are hingedly connected to the shelf support panel and are folded 180° downward in contact with an inner surface of the side wall from which it depends to support a shelf. The display has a first shelf and a second shelf positioned in the gaps. A third panel is folded from a fourth blank of corrugated material and has a front panel and two side panels extending from opposed lateral edges of the front panel and extend orthogonally therefrom. When in the stowed condition a first planar surface of the front panel is in contact with a portion of the first rectangular sleeve and is stacked on top thereof to form a body having a first height. When in the deployed condition, the third panel is hingedly connected to the first rectangular sleeve to form a body of a second height which is 1.5 to 2.5 times greater than the first height. A hinge connects the third panel to the first rectangular sleeve to allow movement from the stowed condition to the deployed condition.

Other features and advantages of the invention will be apparent from the following specification taken in conjunction with the following Figures and Attachments.

BRIEF DESCRIPTION OF THE DRAWINGS

To understand the present invention, it will now be described by way of example, with reference to the accompanying drawings in which:

FIGS. 13.1-13.21 illustrate the steps of erecting a display from the components shown in FIGS. 8-12.

FIGS. 21.1-21.26 illustrate the steps of erecting a display from the components shown in FIGS. 1-7.

DETAILED DESCRIPTION

Figure 1:
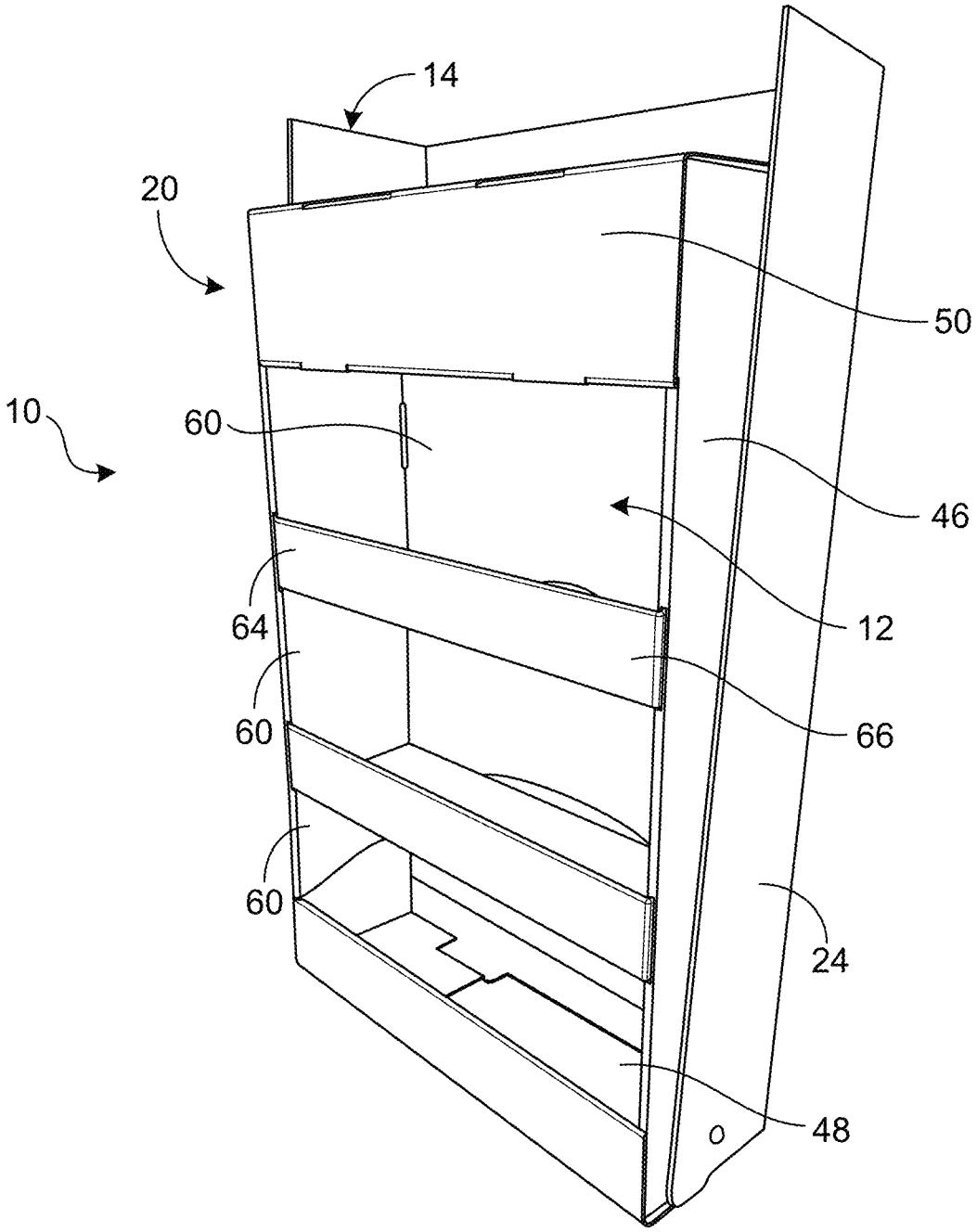
FIG. 1 is a perspective view of a display in a stowed condition.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
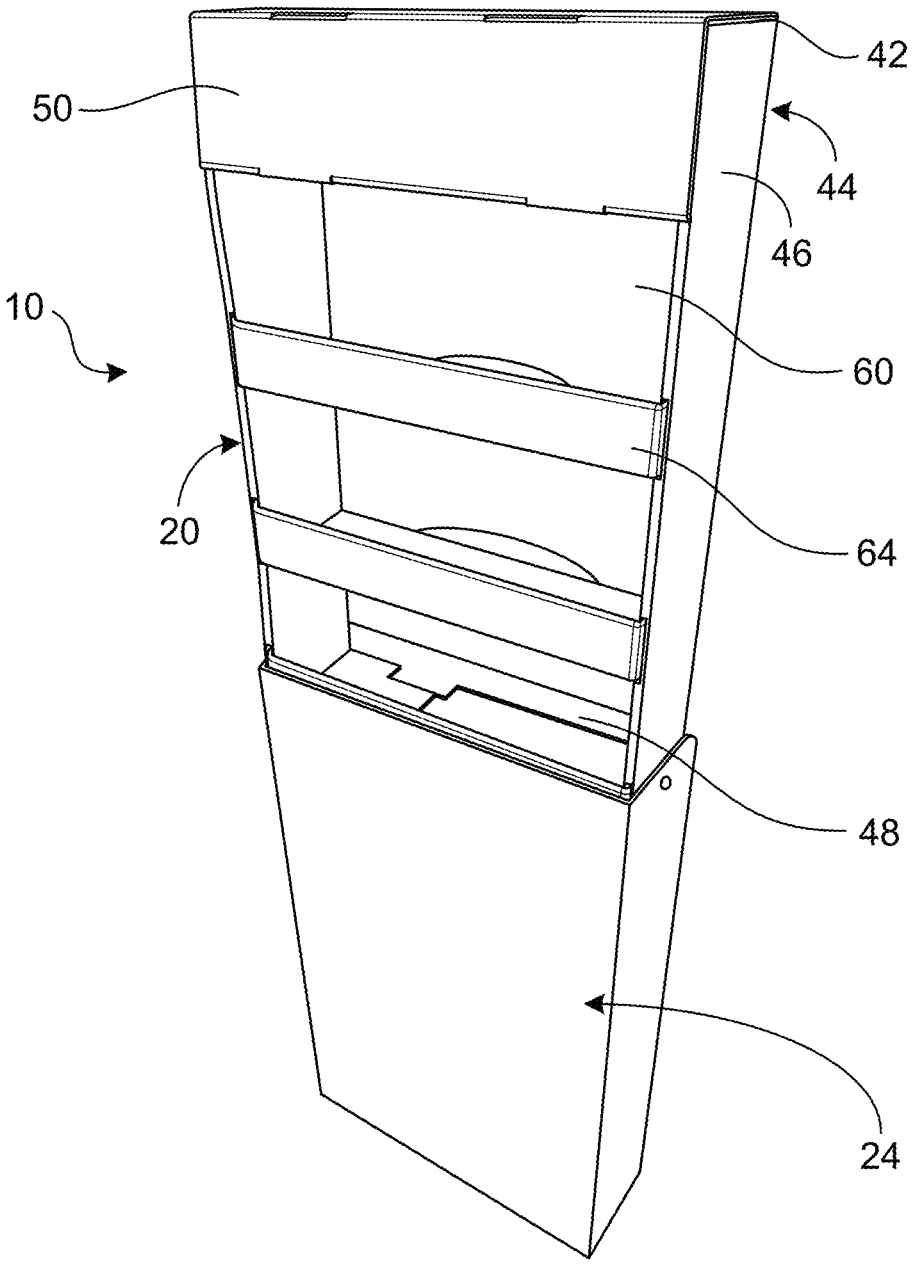
FIG. 2 is a perspective view of a display in a deployed condition.

FIGS. 1-5 show a display 10 for use in the sale of items in a retail sales environment, for example. FIG. 1 shows the display 10 in a stowed condition, and FIG. 2 shows the display 10 in a deployed condition. The stowed condition is used during shipment and storage of the display. When in the stowed condition, the blanks that make up the display are disposed in a nested configuration—blank 22 is in contact with blank 26. The display when in a stowed condition utilizes less volume and surface area than when the display is in the deployed condition. In the deployed condition, the display provides a first portion 12 for holding and displaying packaged products for sale (products not shown). The display 10 provides a second portion 14 for displaying graphic and textual subject matter to provide information such as, e.g., the product name, a description of the product, the price, and why you should buy it. The graphic and textual matter can be printed onto the display or applied in stickers or other fashion that is well known to those of ordinary skill in the art.

FIGS. 1 and 2 show the display 10 has a plurality of rectangular display compartments 60 vertically spaced from one another and extending in parallel spaced relationship with one another between the opposed side walls 46. Three such rectangular display compartments 60 are shown but fewer or greater number can be provided based upon the product display size and shape. It is contemplated any number of display compartments 60 could be provided from 1 to 100, but more likely would be from two to 24, and most preferably from two to 12. Two shelves 64 are shown in the display, although a single shelf 64 could be used or more than two shelves 64 could also be used.

Figure 3:
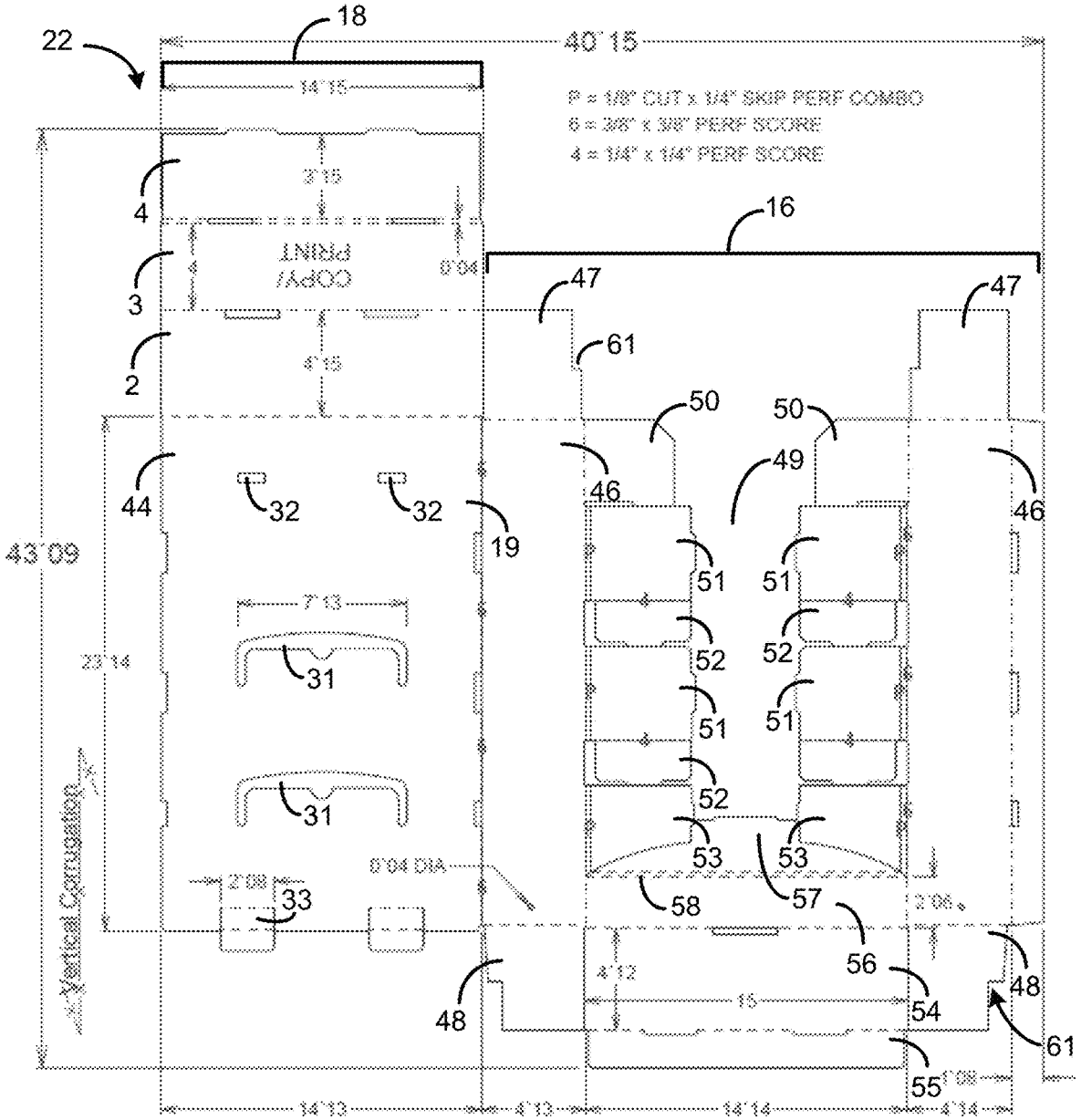
FIG. 3 is a plan view of a blank for forming a portion of the display of FIG. 1.

The display 10 has a rectangular sleeve 20 folded from a first blank of material 22 shown in FIG. 3. The display 10 has a graphics extension panel 24 folded from a second blank 26 shown in FIG. 4. The display 10 also has two shelves 64 each individually folded from a third blank 30 of FIG. 5. The graphics extension panel 24 is hingedly connected to the rectangular sleeve 20 with a tab such as 178 in FIG. 13.13 from one of the parts engaging a slot such as 180 in FIG. 13.13 from another of the parts (See FIGS. 13.11-13.14) or using an adjust-a-lok fastener 11 of FIG. 7 as will be described below with reference to FIGS. 21.1-21.27. When in the stowed condition a height dimension of the assembly is shorter than when in the deployed condition. A height dimension of the display in the deployed condition is from 1.5 to 2.5 times larger than when in the stowed condition.

FIG. 3 shows the blank 22 having a first wing 16 and a second wing 18 connected together along a fold line 19. Each of the first wing 16 and the second wing 18 have multiple panels. The first wing 16 has two opposed side wall panels 46 each terminating at opposed ends with a top tab 47 and a bottom tab 48. A portion of an inner lateral edge of the top tab and bottom tab is removed to form a notch 61. On an inner lateral edge of each side panel 46 extends a segmented shelf support panel. A cutout 49 separates inner edges of the side wall panels 46, and when the display is in a deployed condition, the cutout 49 forms an opening or access to the rectangular display compartments 60. Each segmented side panel has a head flange 50, a tail flange 53, and two shelf support flaps 51 adjacent two gaps 52. The gaps 52 and support flaps 51 are to receive and support opposed ends of a shelf 64 folded from a blank 30 of FIG. 5, which shall be described below.

The first wing 16 also has a front panel 56, a bottom panel 54, a tab 55, and a bottom wall panel 57 connected by a fold line 58 to a top edge of the front panel 56. These when deployed will form a bottom portion of the rectangular sleeve.

The second wing 18 of the blank 22 (FIG. 3) has a back wall 44 with two C-shaped cutouts 31 spaced vertically from one another, and two square cutouts 32 horizontally spaced from one another and proximate a top edge of the back panel 44. The back wall has a pair of tabs 33 spaced along a bottom edge of the back wall 44. The second wing also has a top panel 2, a header panel 3, for supporting graphical and textual material, and a cover panel 4 that serves to hide the hollow chamber behind the header panel.

Figure 4:
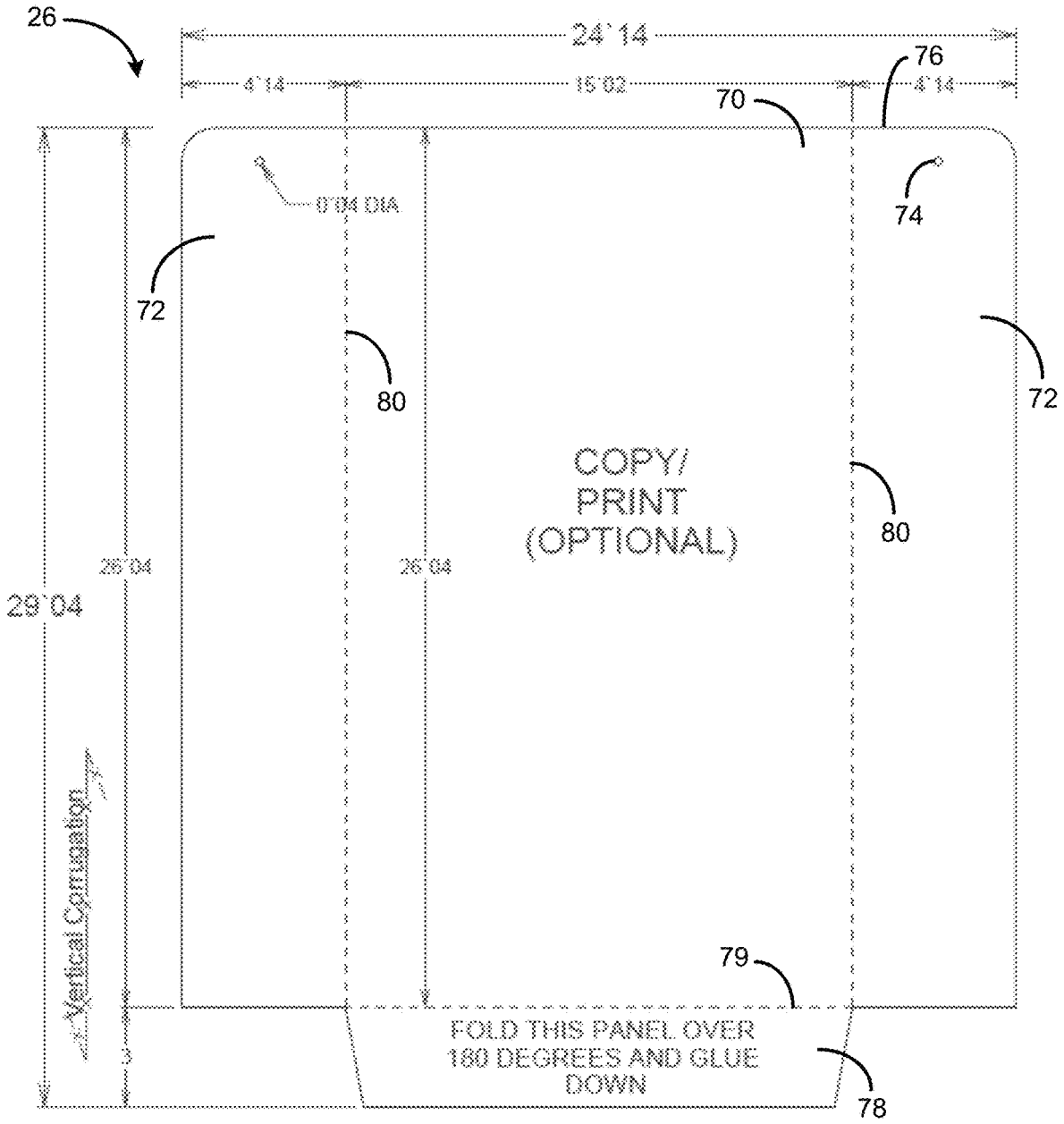
FIG. 4 is a plan view of a blank for forming a graphics extension panel of FIG. 1.

FIG. 4 shows the blank 26 for forming the graphics extension panel has a front panel 70 flanked by two side panels 72 opposed to one another. A hole 74 is provided on each of the two side panels 72 proximate a top end 76. As shown in FIG. 21.11, the hole 74 is placed in alignment with a hole 75 in the side wall 46. A male fastener is inserted through the aligned holes from one side, and a female fastener 76 is inserted into the aligned holes from the opposite side. Threads in the male fastener are mated with threads on the female fastener to releasably, and hingedly attach the graphics extension panel 24 to the rectangular sleeve 20. A bottom tab 78 extends from a bottom end 79 of the front panel. To erect the panel extension 26, the side panels 72 are folded along fold lines 80 to be orthogonal to the front panel 70 and the bottom tab 78 is folded along fold line 79 180°, and an outer planar surface of the tab is attached to an inner planar surface of the front panel 70 by an adhesive to create rigidity in the panel to prevent false scoring.

Figure 5:
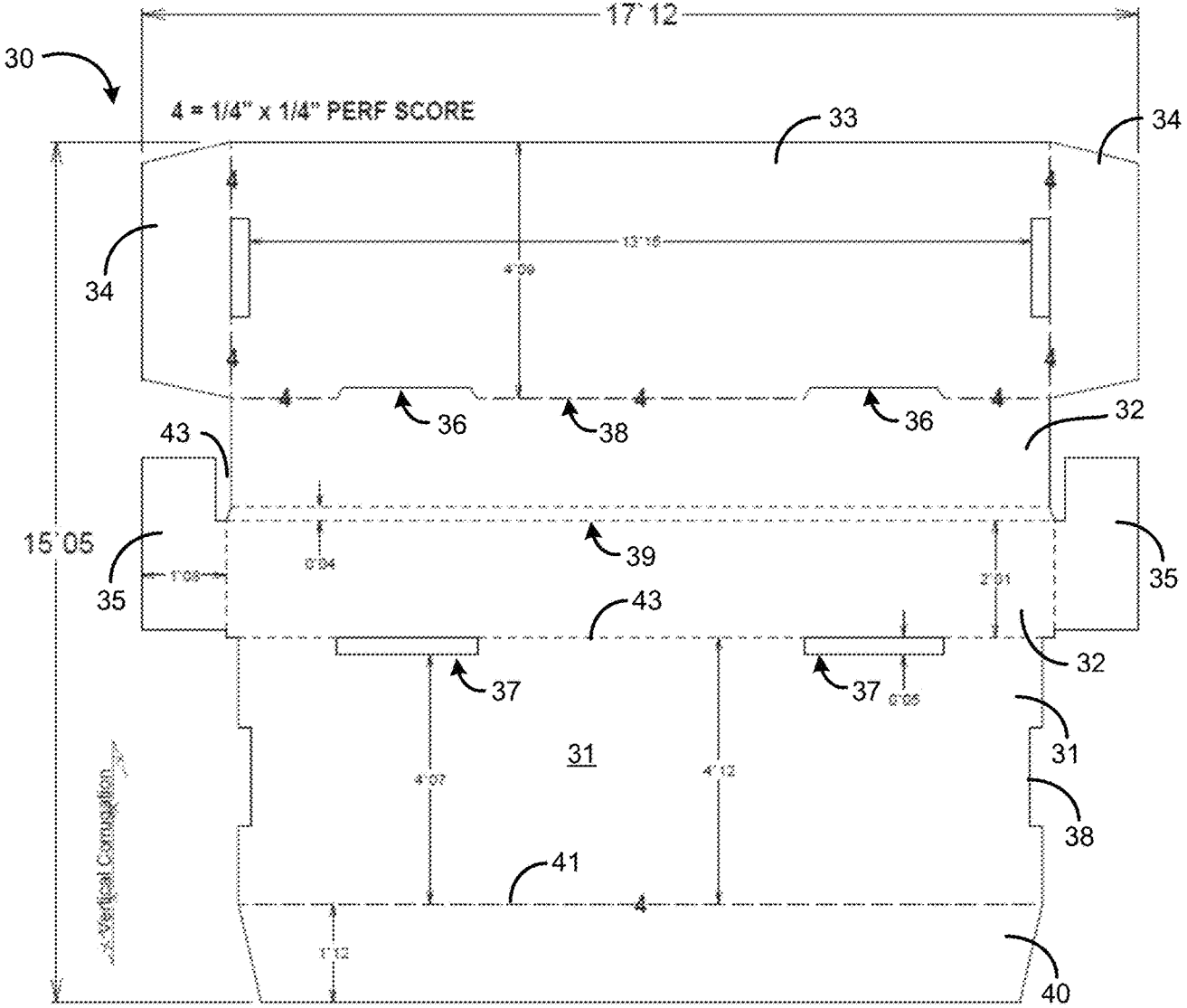
FIG. 5 is a plan view of a blank for forming a shelf in the display of FIG. 1.
Figure 6:
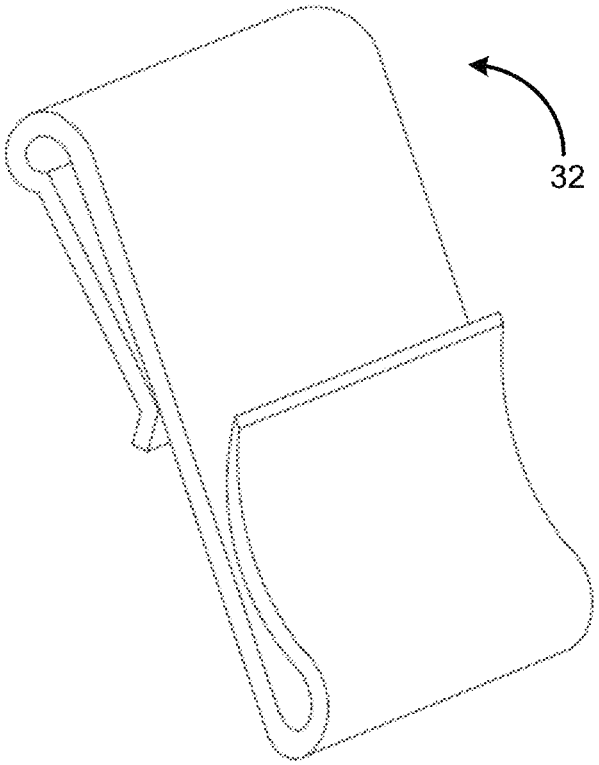
FIG. 6 is a perspective view of a U-shaped clip used in the display of FIG. 1.

Now for a description of a shelf 64. As best seen in FIGS. 5 and 21.12-21.17, the shelf 64 is deployed from a blank 30. The blank 30 has a first base panel 31, a second base panel 33, two back panels 32. A first pair of side panels 34 extend from opposed lateral edges of the second base panel 33. A second pair of side panels 35 extend from opposed lateral edges of one of the back panels 32. A portion of the side panels 35 is removed to form a gap 43, or a slot 43, respectively of when the display is in the stowed condition or the deployed condition. The blank 30 also has a pair of tabs 36 on a proximal edge of the second base panel 33, and a pair of slots 37 on a proximal edge of the first base panel 31. The blank has a first fold line 38 and a second fold line 39 extending in parallel spaced relationship. The blank also has tab 40 extending from a distal edge of the first side panel 31 along a hinge 41.

One preferred sequence of folding the blank 30 is shown in FIGS. 21.12-21.17. First the side panels 34 and 35 are folded at 90° into the form of a C-shaped body, and the blank 30 is folded along fold line 38 90° placing the first and second back panels 32, the first base panel 31, and the tab 40 in a first plane perpendicular to a second plane extending through the second base panel 33 (FIG. 21.13) to define an L-shaped body. With reference to FIG. 5, one has to imagine the tab 40, the first base panel 31, etc., are coming out of the paper at a 90° angle and the second base panel 33 is in the plane of the paper. Now the L-shaped body of FIG. 21.13 is folded along line 41 to form a Z-shaped body in FIG. 21.14. The blank 30 is then folded along line 39 such that the back panels are folded upon themselves to form a double thickness back wall 44. The first base panel 31 is folded on top of the second base panel 33 to form a double thickness base wall. The tab 40 is folded down 90° (FIG. 21.16) between the side panels 34. The shelf 64 is now ready for use in the rectangular sleeve as will now be described.

FIGS. 21.18-21.27 show the sequence of incorporating a shelf 64 into the rectangular compartments 60 and the process will be repeated for additional shelves. The shelf 64 is aligned with the gaps 52 and slid into the compartment. A portion of the back panel 32 is inserted through the slot 31 in the back wall 44 to support the shelf as is shown in FIG. 21.20. The shelf support flaps 51 are folded downward and inward 270° into contact with an inner surface of the side wall 46 and the side panels 35 are folded inward to support the shelf 64 as is shown in FIGS. 21.22-21.24. The bottom wall is then folded as shown to complete the rectangular sleeve portion of the display.

FIGS. 8-12 show an alternative display 100 much the same as shown in FIGS. 1-5 but with some differences. The display 100 has a rectangular sleeve 102 folded from a first blank 104 of FIG. 9, and a graphic extension panel 124 folded from a second blank 106 of FIG. 12. The graphic extension panel 124 is connected to the rectangular sleeve with tabs on the graphic panel engaging slots in the rectangular sleeve and without the use of the fasteners shown above. (See FIGS. 13.13 and 13.14) However, the adjust-a-lok fastener could also be used. Two rectangular display compartments 160 extend in parallel spaced relationship between the opposed side walls 146.

Figure 9:
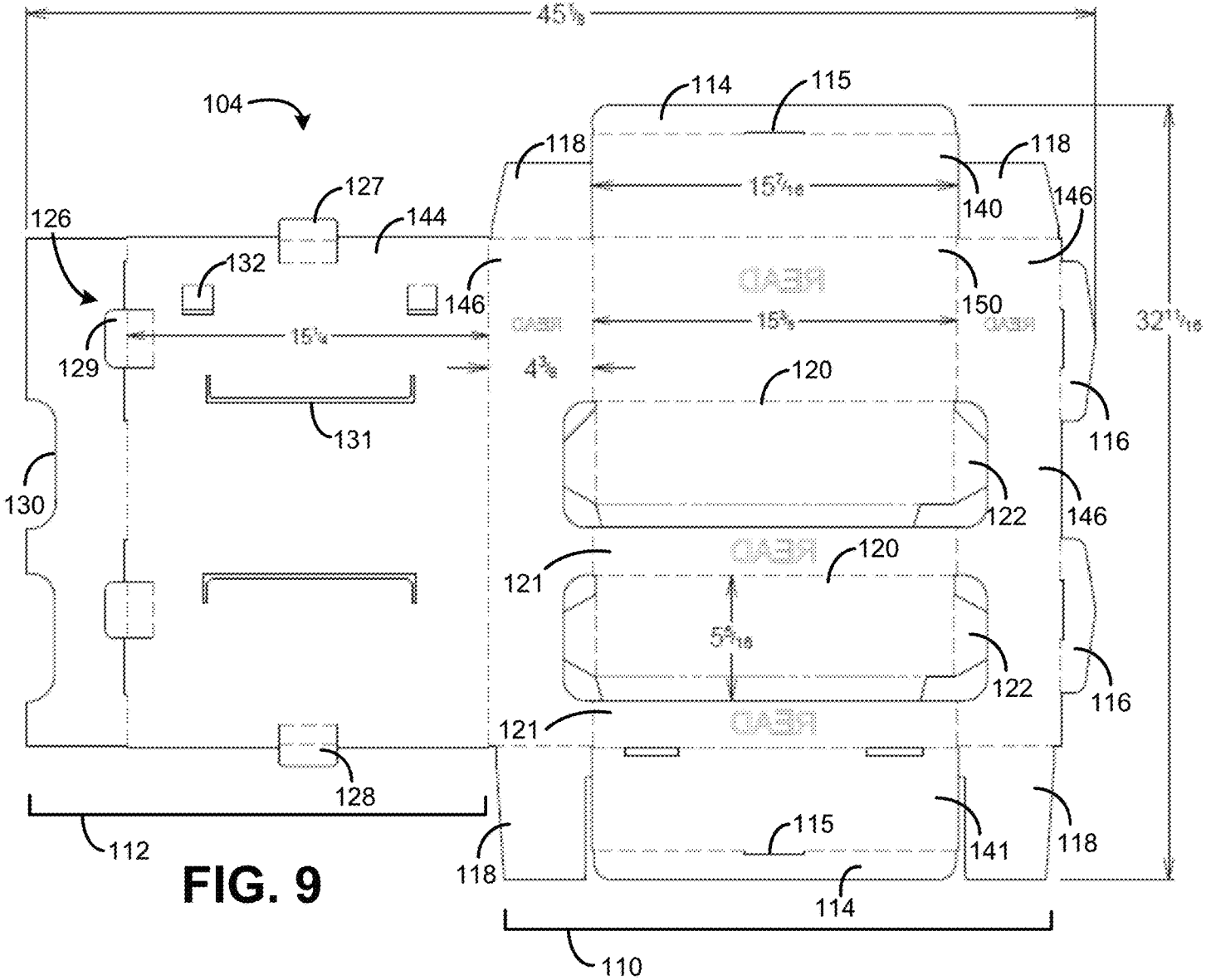
FIG. 9 is a plan view of a blank for forming a portion of the display of FIG. 8.

FIG. 9 shows the blank 104 which can be folded by a hand of a user of the display (as is set forth in detail in FIGS. 13.1-13.28 and described below) for forming the rectangular sleeve 102. The blank 104 has a first wing 110 hingedly connected to a second wing 112. Each wing 110,112 has several panels. The first wing 110 has a top panel 140 at one end of the blank, and a bottom panel 141 at an opposed end of the blank 104. A pair of opposed side panels 146 extend from lateral edges of the first wing 110. Both the top panel and bottom panel 140,141 terminate at a distal end in a tab 114 connected by a hinge. At a central point of the tab 114, on a proximal edge thereof, is a combination tab/slot 115. One of the side walls 146, the one on the right in FIG. 13.1, has two combination tab and slots 116 spaced along a leading edge of the side wall 146. Each opposed top and bottom end of the side walls terminate respectively in a top tab or a bottom tab 118 separated by a hinge.

A top header panel 150 is connected to the top panel 140 along a hinge. Two shelf panels 120 extend in parallel spaced relationship between the opposed side walls 146 and terminate at opposed ends with a combination of a lateral shelf tab 122 and lateral shelf tab slot 124. A vertical surface 121 is associated with each shelf panel 120 and can serve as a lip to hold products in the display, and as a surface to support graphical and textual subject matter. In FIGS. 13.1 and 13.2, during folding of the blank 104, the lateral shelf tab 122 remains in the same plane as the shelf panel, but the lateral shelf tab slot 124 moves with the side wall 146 to a position perpendicular thereto, and the lateral shelf tab 122 is inserted into the lateral shelf tab slot 124 to retain the side wall 146 perpendicular to the back wall.

The second wing 112 has a back panel 144, an inside side wall 126, a combination top tab and slot 127, a combination bottom tab and slot 128, and two side tab and slot combinations 129 spaced from one another along a lateral edge of the second wing 112. On a leading edge of the inside side wall panel 126 has two cutouts 130 spaced from one another. The back panel 144 has two C-shaped cutouts 131 spaced vertically from one another and two square cutouts 132 horizontally spaced from one another and proximate a top edge of the second wing 112.

Figure 12:
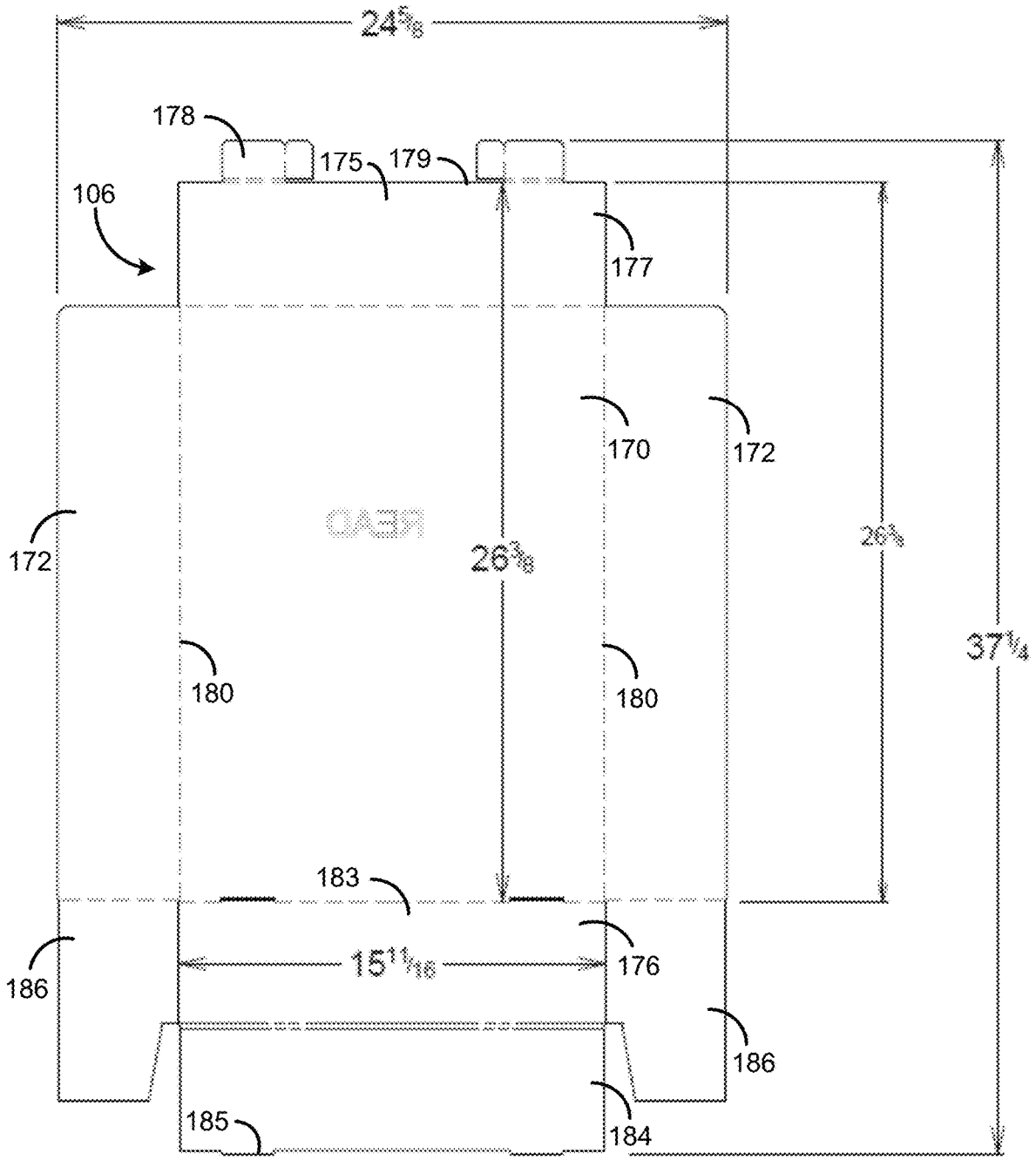
FIG. 12 is a plan view of a blank for forming a graphics extension panel of FIG. 8.

The graphics extension panel is folded from the blank 106 shown in FIG. 12 and FIGS. 13.9-13.12. The blank 106 has a front panel 170, opposed side panels 172, a top flap 175, and a bottom flap 176. The top flap 175 has a flap panel 177 and two tabs 178 horizontally spaced from one another and attached to a leading edge 179 of the flap panel 177. The tabs 178 are segmented. The bottom flap 176 has a panel 183, a tab 184 extending from the panel 183 and having two, horizontally spaced flanges 185. The bottom flap 176 also has two side tabs 186 extending from lateral edges of the panel 183.

Figure 10:
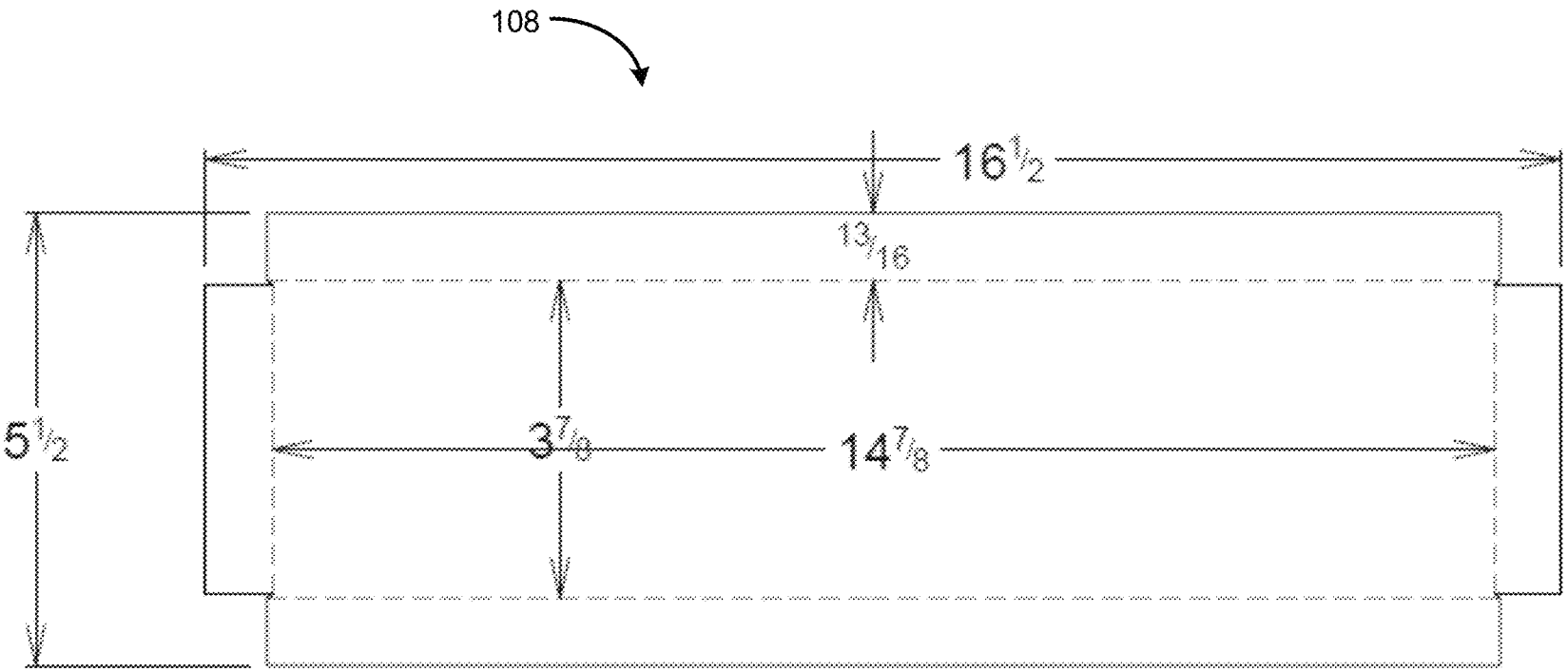
FIG. 10 is a plan view of a blank for forming a platform of the display of FIG. 8.

An optional platform can be placed on top of the shelves 120 or the shelves 64 in FIG. 2 to support products a little higher in the rectangular compartments and is folded from a blank 108 shown in FIGS. 10, 13.15, and 13.16. The folded platform is placed directly on top of the shelves 120 or the shelves 64 in FIG. 2.

Figure 8:
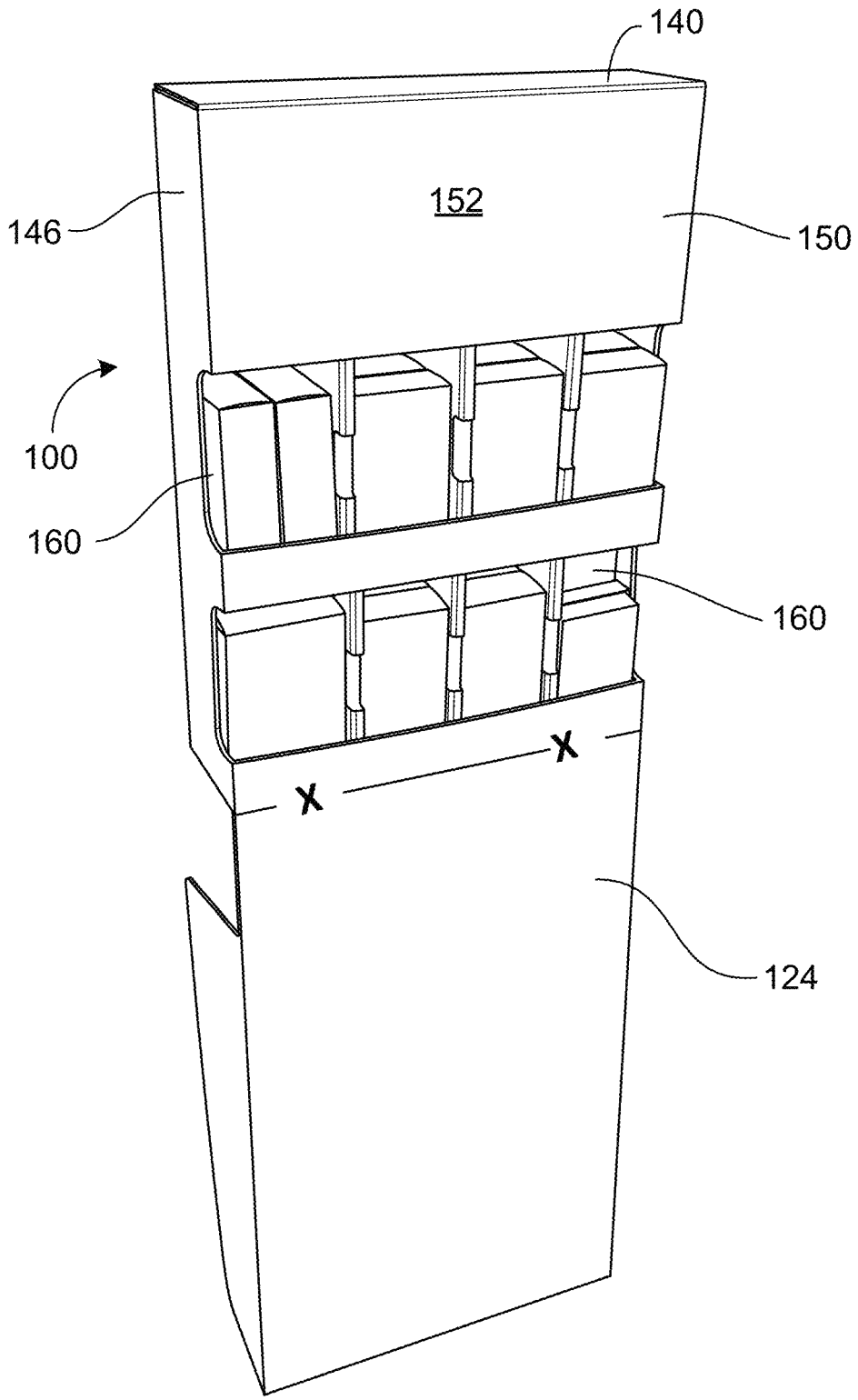
FIG. 8 is a perspective view of an alternative display in a stowed condition.
Figure 11:
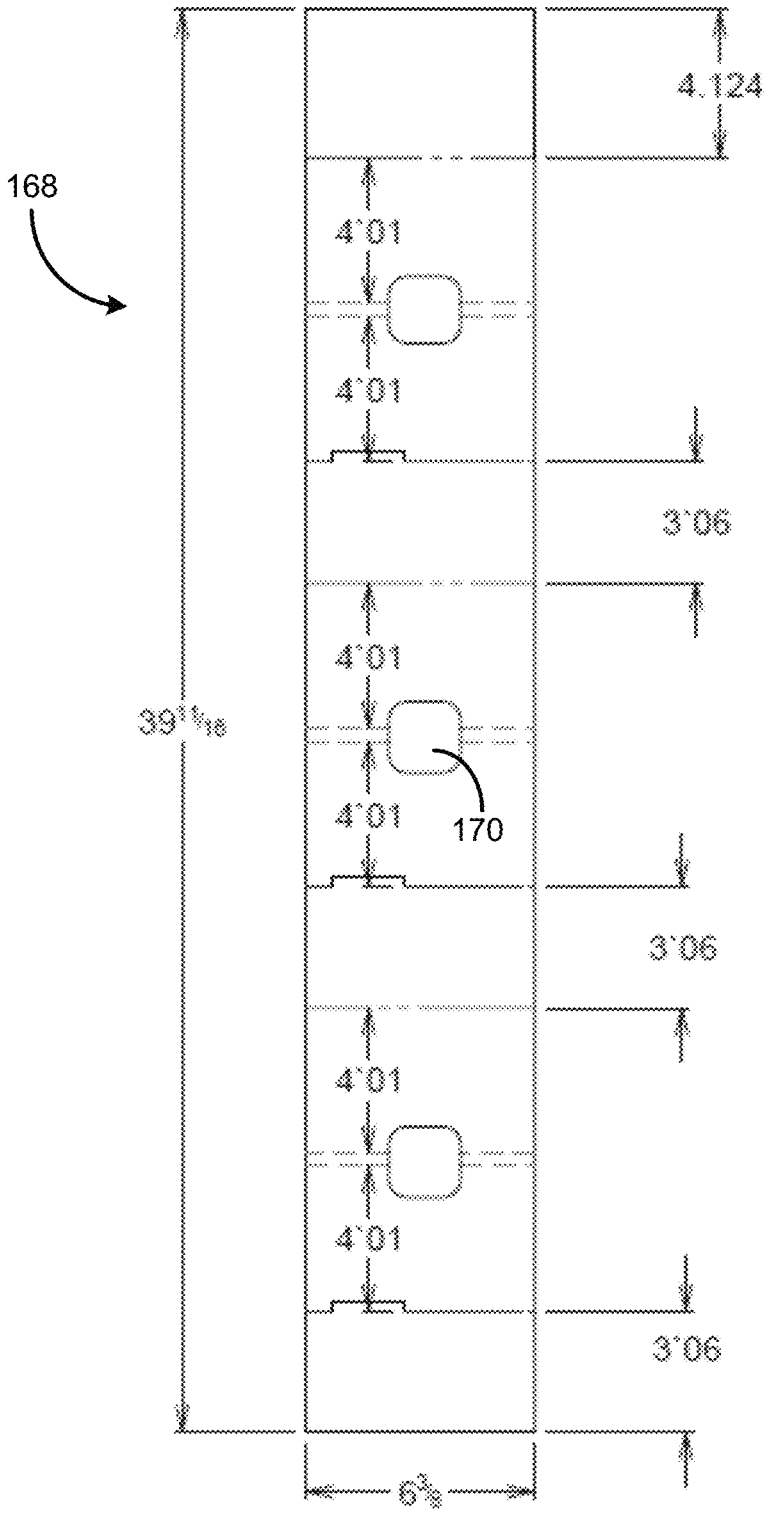
FIG. 11 is a plan view of a blank for forming a divider in the display of FIG. 8.

FIG. 11 shows a blank 168 for forming a divider. Each of the rectangular display compartments 160 shown in FIG. 8 are further divided into four sub-chambers 165 by a divider 166 folded from the blank 168 of FIG. 11 and as shown in FIGS. 13.17 and 13.18. A front edge of the divider 166 has a portion removed 170 to provide access to the products by a consumer or user of the display. Two such rectangular display compartments 160 are shown with eight sub-chambers but fewer or greater number of compartments or sub-chambers 165 can be provided based upon the product display size and shape. It is contemplated any number of display compartments 160 and sub-chambers 165 could be provided from 1 to 100, but more likely would be from two to 24, and most preferably from two to 12. The divider 166 can also be placed in the display compartments shown in FIG. 1.

FIGS. 13.19A-D-13.21 show an optional BR filler 190 which is essentially a rectangular shaped box that is inserted into a subchamber to fill space.

FIGS. 13.1-13.8 show the folding of the blank 104 into the rectangular sleeve 102. The blank 104 is placed flat on a surface and the second wing 112 is folded toward the first wing until the side wall 146 is perpendicular to the second wing and the back panel 144 is folded an additional 90° to be in a parallel plane to the second wing and vertically spaced therefrom. The inside side wall 126 is folded an additional 90° until a leading edge of the inside side wall 126 is in contact with the back wall. (FIG. 13.2) The other side wall 146 is folded 90° from the back wall and is in face-to-face contact with the inside side wall 126 to form a sidewall with double thickness. (FIG. 13.3) The tabs are folded as indicated to form the rectangular sleeve 102 secured together to prevent unfolding as is shown in FIGS. 13.4-13.6. The shelves are then folded into position as shown in FIGS. 13.7 and 13.8 and a portion of each shelf extends through the C-shaped slot 131 of the back wall 144 to support the shelf. This completes the assembly of the rectangular sleeve 102.

The graphics panel extension 124 is folded from the blank 106 into a rectangular body and the tabs 178 are inserted into slots 180 of the rectangular sleeve to hingedly connect the two parts as is shown in FIGS. 13.13 and 13.14. When in the deployed condition, the graphics panel extension 124 extends from the rectangular sleeve 102. (FIG. 13.13) When in the stowed condition, the graphics panel extension 124 is folded upward so that a panel 184 of the graphics panel extension 124 is in contact with a bottom surface of the rectangular sleeve 102 and the rectangular compartment encompasses the side walls and the back wall. When in the stowed condition a height dimension of the assembly is shorter than when in the deployed condition. A height dimension of the display in the deployed condition is from 1.5 to 2.5 times larger than when in the stowed condition.

Figure 14:
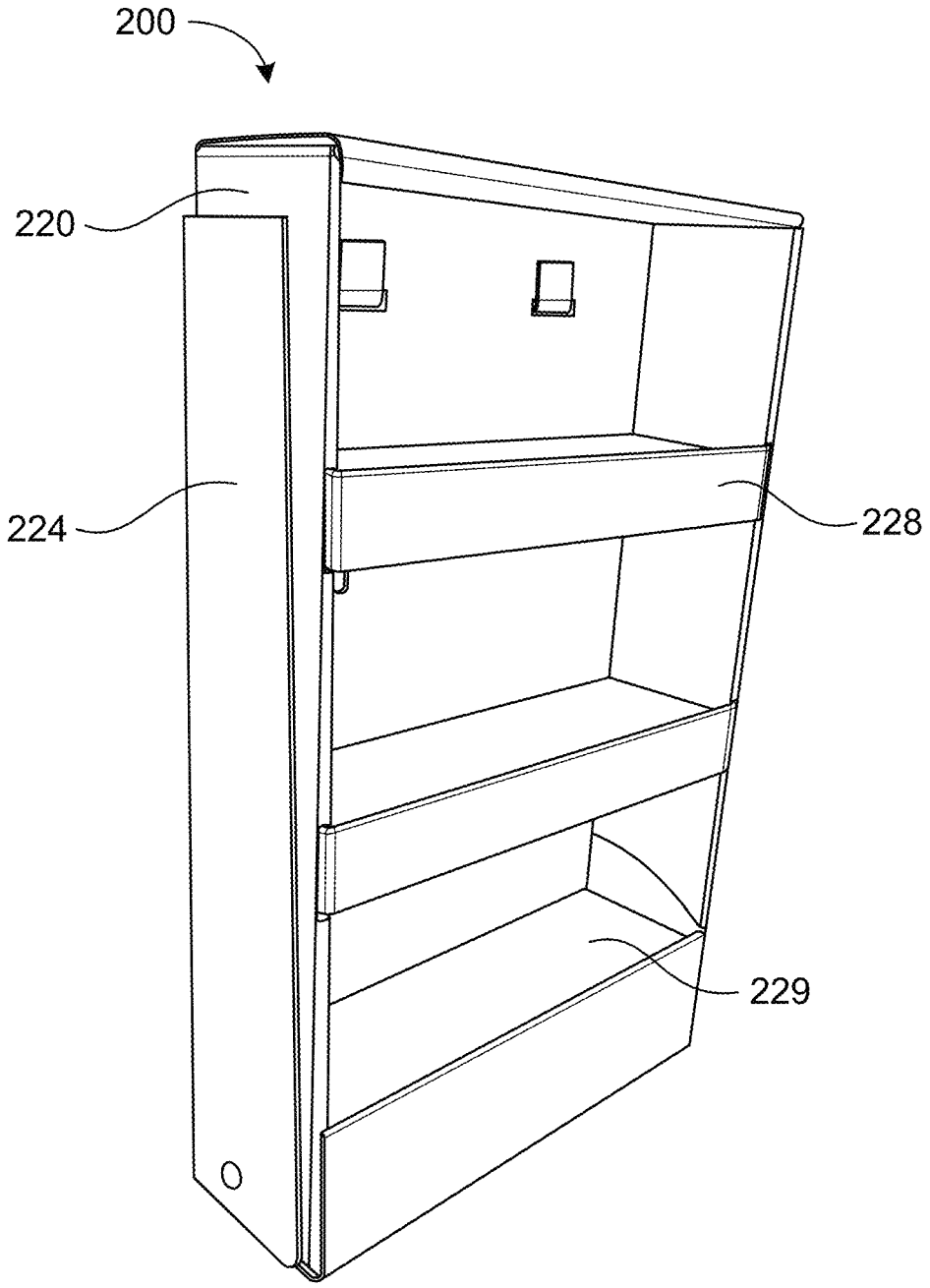
FIG. 14 is a perspective view of an alternative display in a stowed condition.
Figure 15:
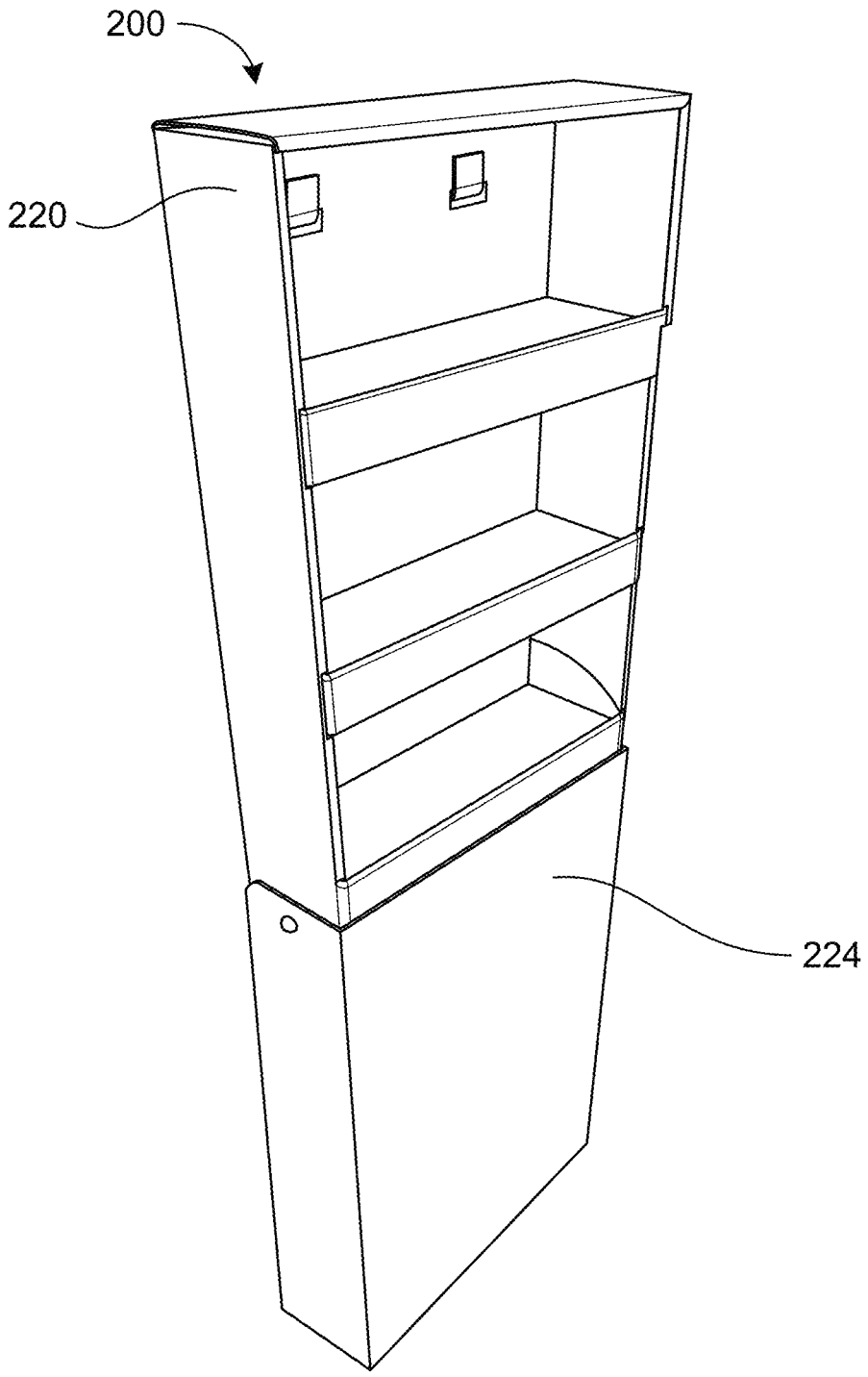
FIG. 15 is a perspective view of an alternative display in a deployed condition.
Figure 24:
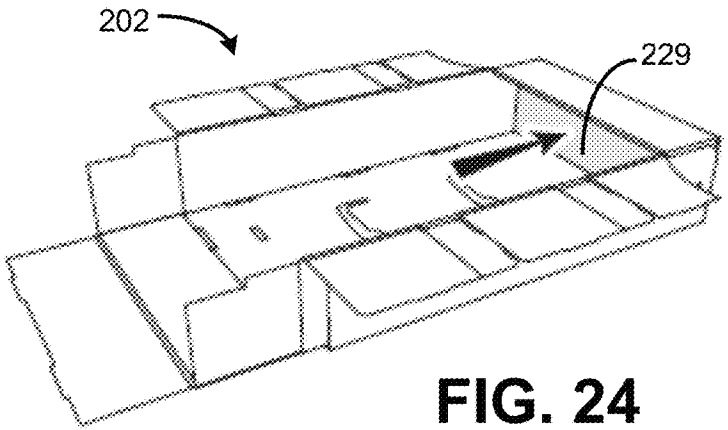
FIGS. 22-24 illustrate the steps for folding a false bottom and incorporating it into the display.

FIGS. 14-20 show an alternative display 200 of the present invention in the stowed condition in FIG. 14 and in a deployed condition in FIG. 15. The display 200 has a rectangular sleeve 220 folded from a first blank of material 222 shown in FIG. 16. The display 200 has a graphics extension panel 224 folded from a second blank 226 shown in FIG. 19. The display 200 also has two shelves 228 each individually folded from a third blank 230 of FIG. 17. The display also has and a false bottom 229 as shown in FIG. 24. The graphics extension panel 224 is hingedly connected to the rectangular sleeve 220 with an adjust-a-lok fastener 11 of FIG. 7 as will be described below.

Figure 16:
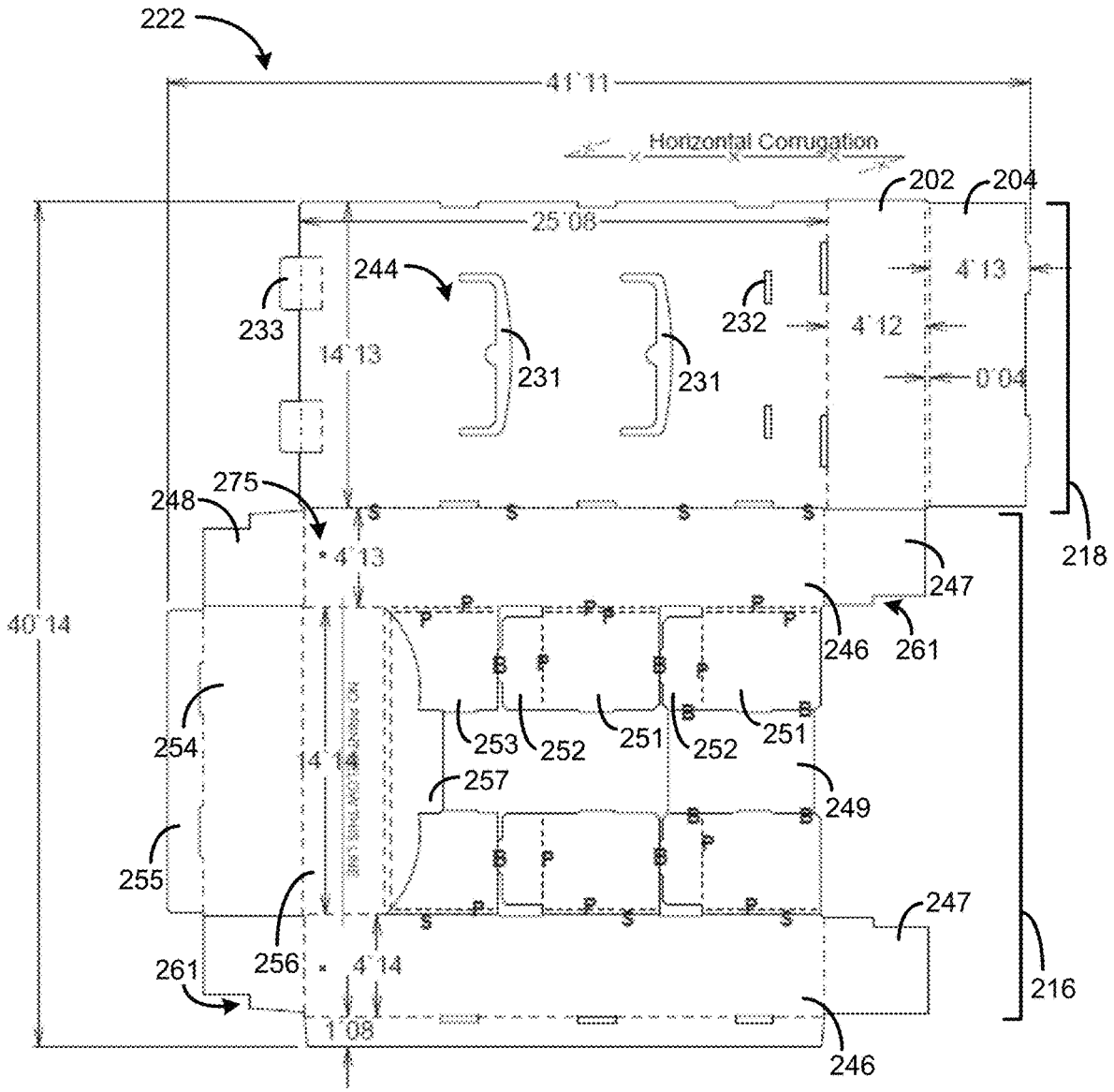
FIG. 16 is a plan view of a blank for forming a portion of the display of FIG. 14.
Figure 17:
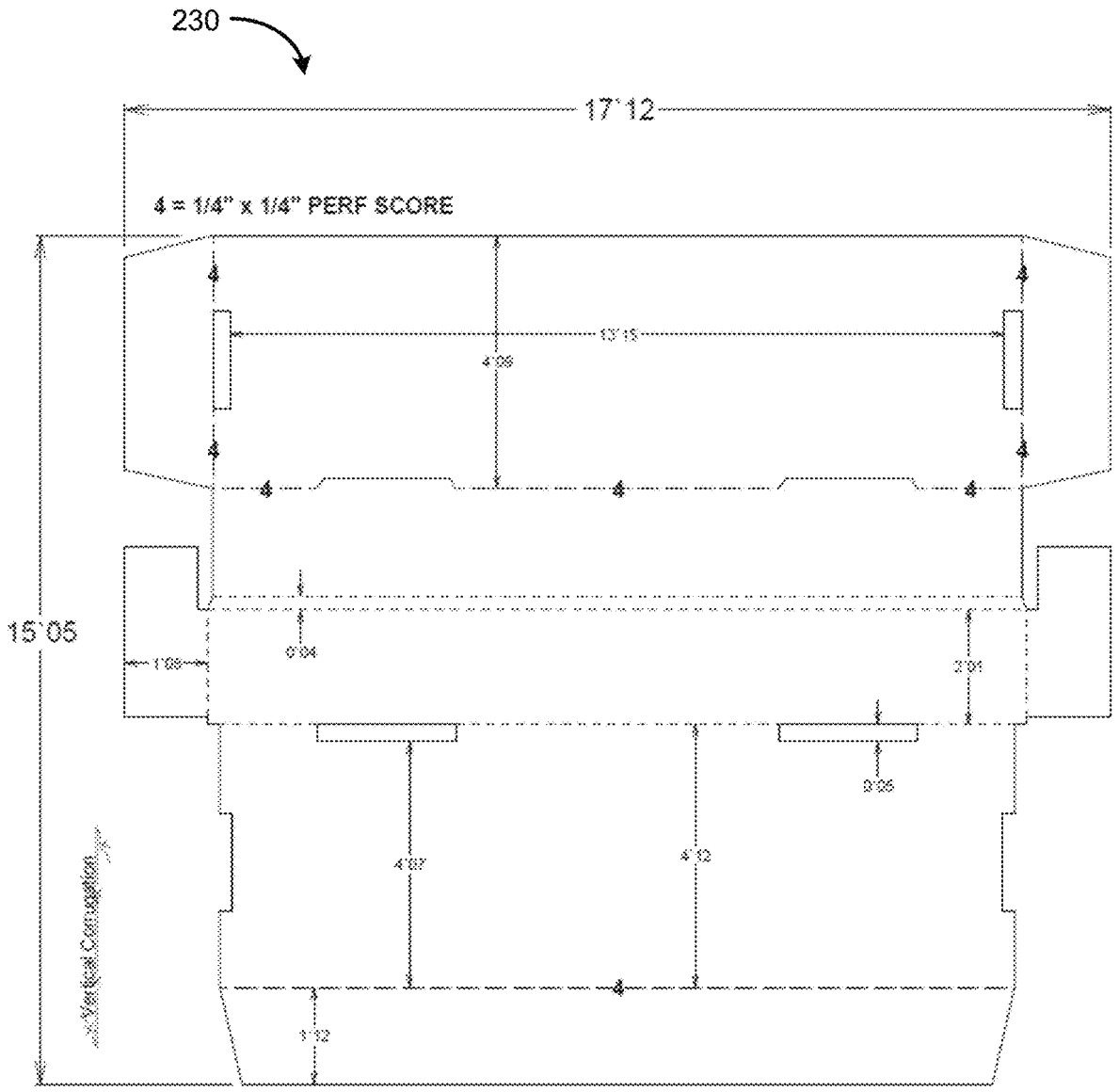
FIG. 17 is a plan view of a blank for forming a shelf of the display of FIG. 14.
Figure 18:
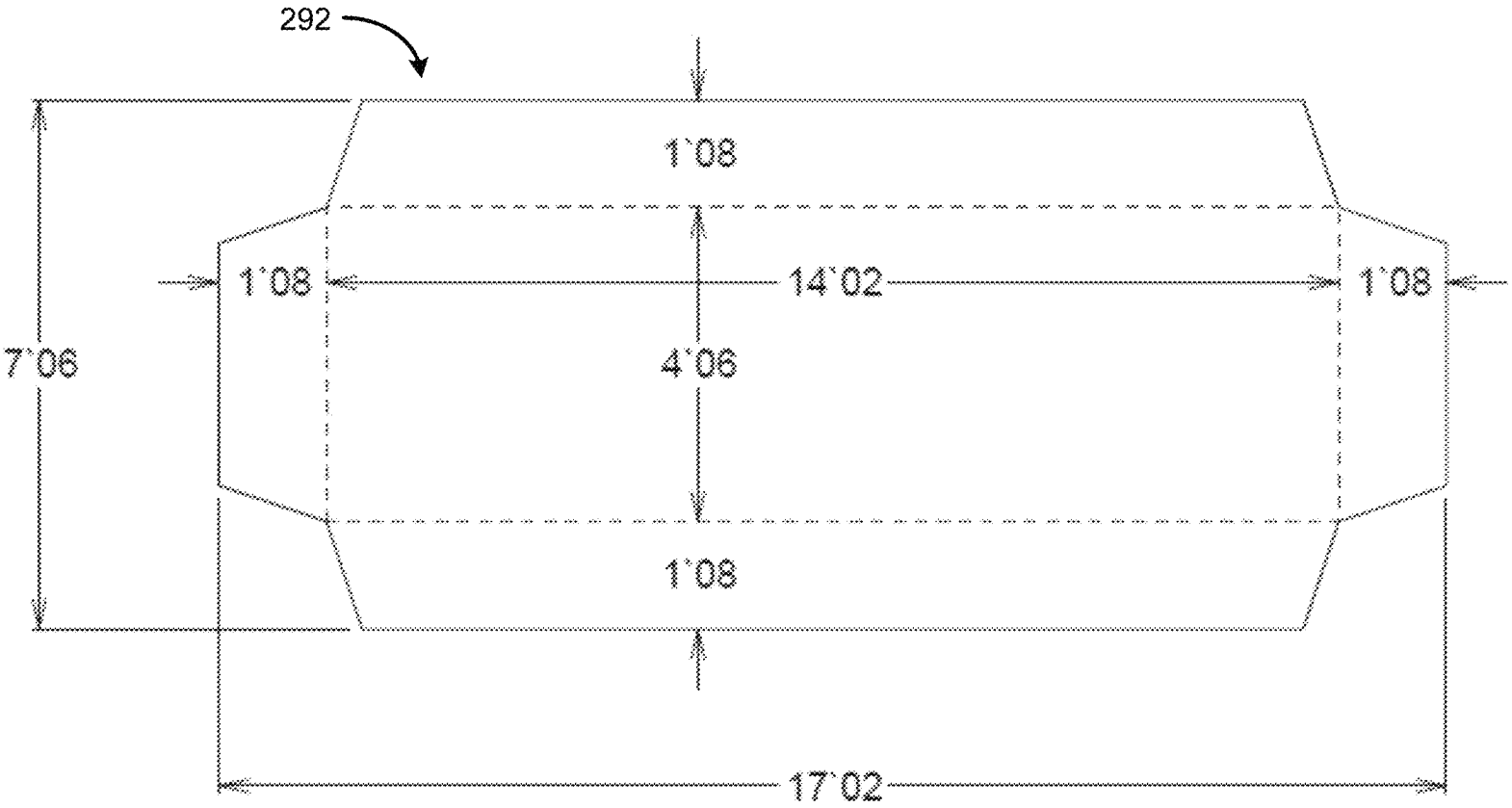
FIG. 18 is a plan view of a blank for forming a riser of the display of FIG. 14.

FIG. 16 shows the blank 222 having a first wing 216 and a second wing 218 connected together along a fold line. Each of the first wing 216 and the second wing 218 have multiple panels. The first wing 216 has two opposed side panels 246 each terminating at opposed ends with a top tab and a bottom tab 248. A portion of an inner lateral edge of the top tab and the bottom tab is removed to form a notch 261. A segmented support panel extends from an inner lateral edge of the side panel 246. A cutout 249 separates inner edges of the segmented support panels, and when the display is in a deployed condition, the cutout 249 forms an opening or access to the rectangular display compartments. Each segmented support panel 247 has a head flange, a tail flange 253, and two shelf support flaps 251 and two gaps 252 alternating along a vertical dimension of the display. The gaps 252 and support flaps 251 are to receive and support opposed ends of a shelf or a false bottom 229 folded from a blank 281 of FIG. 20, which shall be described below.

The first wing 216 also has a front panel 256, a bottom panel 254, a tab 255, and a bottom wall panel 257 connected by a fold line to a top edge of the front panel 256. These panels when deployed will form a bottom portion of the rectangular sleeve.

The second wing 218 of the blank 222 (FIG. 16) has a back wall 244 with two C-shaped cutouts 231 spaced vertically from one another. The back wall also has two square cutouts 232 horizontally spaced from one another and proximate a top edge of the back panel 244. The back wall has a pair of tabs 233 spaced along a bottom edge of the back wall 244. A top panel 202 and a header panel 204, much reduced in vertical dimension when compared to the header panel 3 of FIG. 3. A false bottom 229 is used in the display above and is folded from the blank 281 of FIG. 20.

Figure 7:
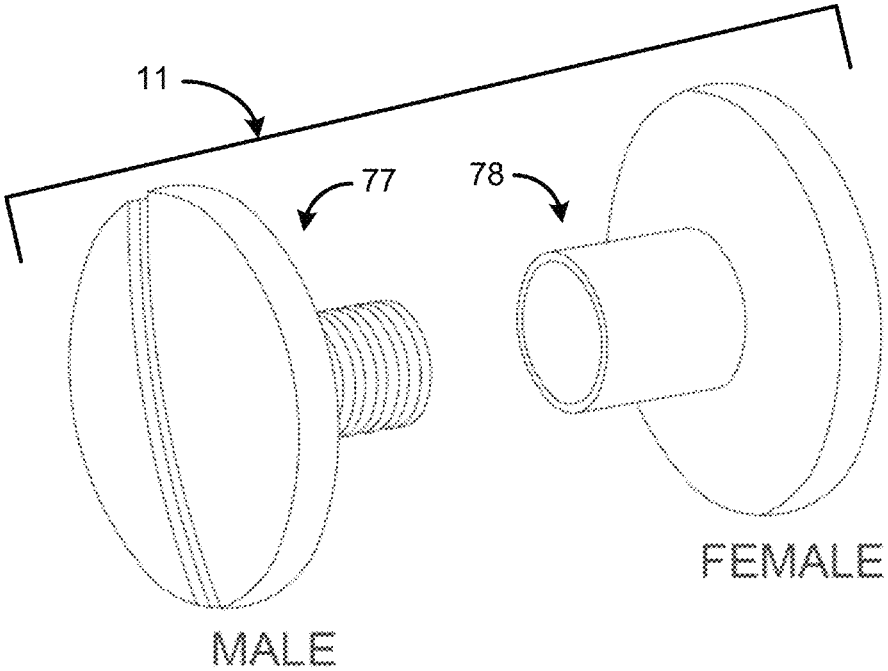
FIG. 7 is a perspective view of an adjust-a-lok fastener system used in the display of FIG. 1.
Figure 19:
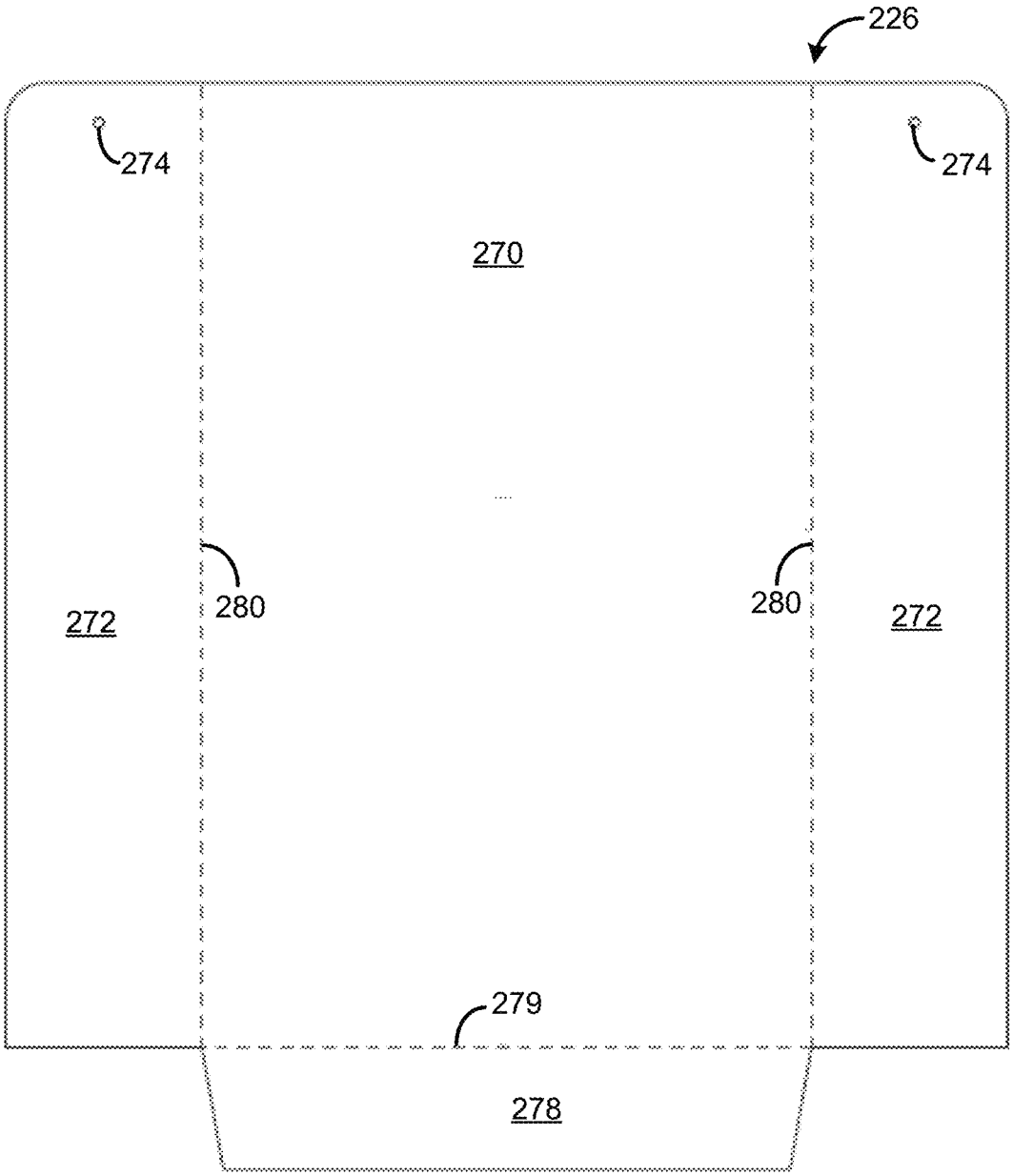
FIG. 19 is a plan view of a blank for forming a graphics extension panel of FIG. 14.

FIG. 19 shows the blank 226 for forming the graphics extension panel has a front panel 270 flanked by two side panels 272 opposed to one another. A hole 274 is provided on each of the two side panels 272 proximate a top end. Just as is shown in FIG. 21.11, the hole 274 is placed in alignment with a hole 275 in the side wall 246 and a male fastener is inserted through the aligned holes from one side, and a female fastener is inserted into the aligned holes from the opposite side, and threads in the male fastener are mated with threads on the female fastener to releasably, and hingedly attach the graphics extension panel to the rectangular sleeve. A bottom tab 278 extends from a bottom end 279 of the front panel. To erect the panel extension 226, the side panels 272 are folded along fold lines 280 to be orthogonal to the front panel 270 and the bottom tab 278 is folded along fold line 279 180°, and an outer planar surface of the tab is attached to an inner planar surface of the front panel 270 by an adhesive. The graphics extension panel 226 has a front panel 270 flanked by two side panels 272 opposed to one another. A hole 274 is provided on each of the two side panels 272 proximate a top end. The adjust-a-lok fastener in FIG. 7 is placed in the hole to attach the graphic extension panel to the rectangular sleeve.

The display 200 can also incorporate a shelf 64 as described above.

Figure 20:
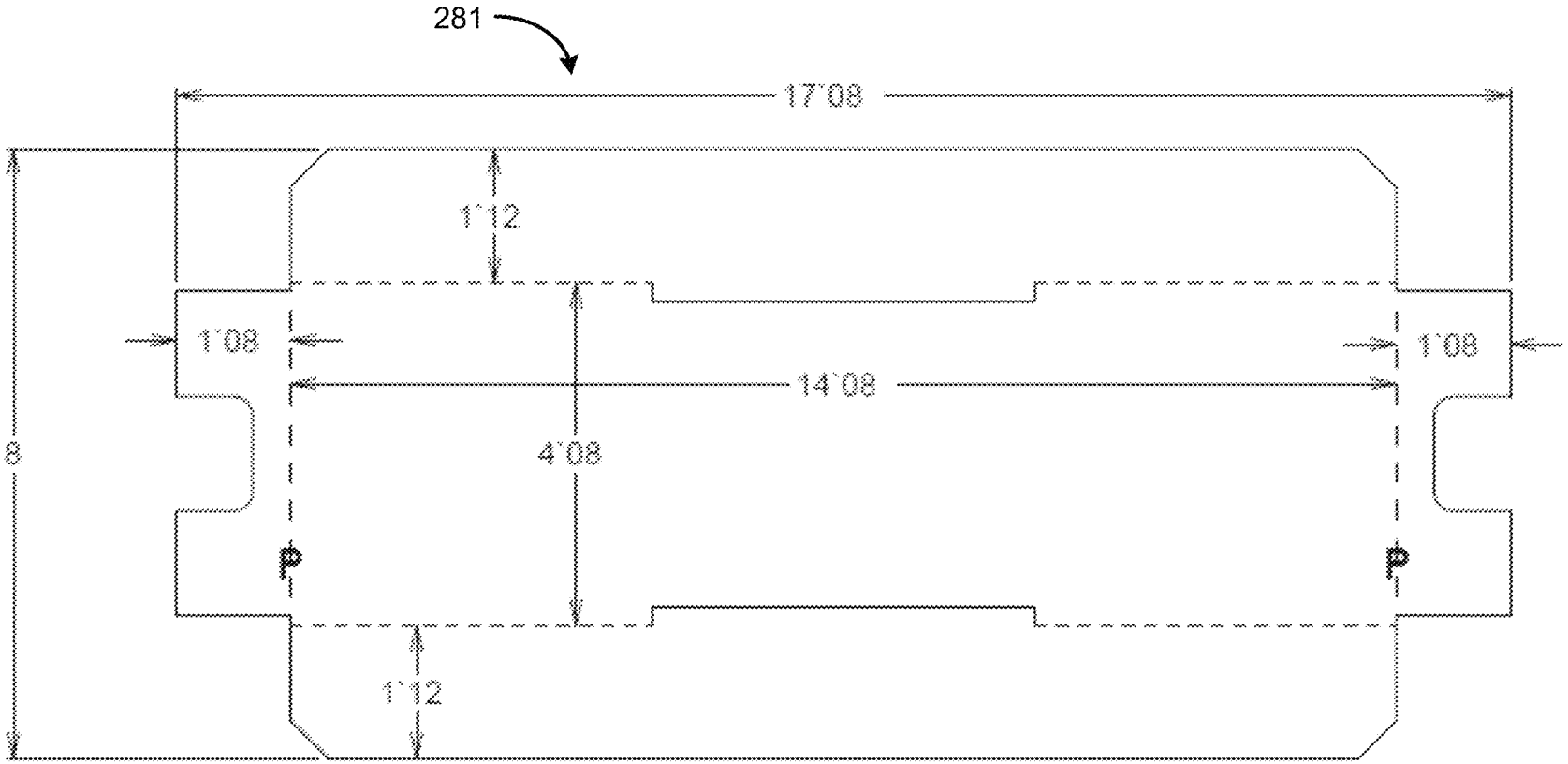
FIG. 20 is a plan view of a blank for forming a false bottom.
Figure 22:
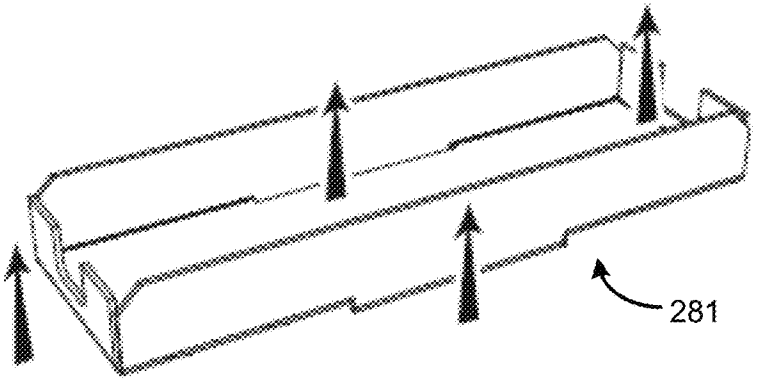
Figure 23:
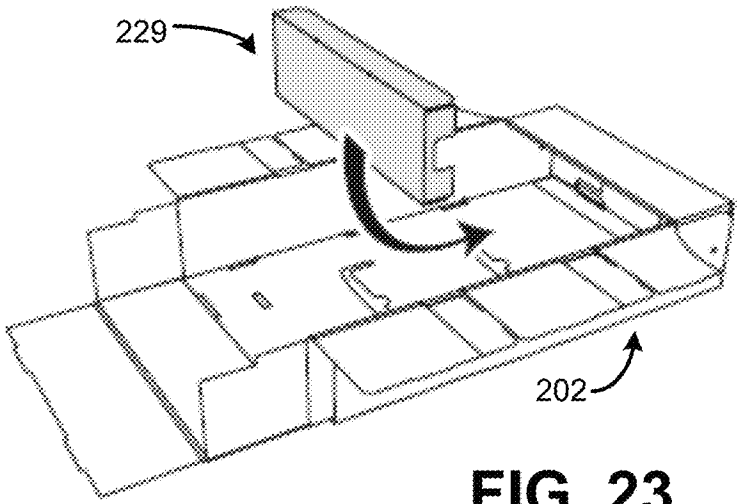

The display 200 can also incorporate a false bottom 229 folded from the blank 281 of FIG. 20 as shown in FIG. 22 and is incorporated into the display as shown in FIGS. 22-24 and is positioned in a top portion of an inner chamber with a planar surface facing downward to act as a ceiling of the rectangular chamber.

Figure 25:
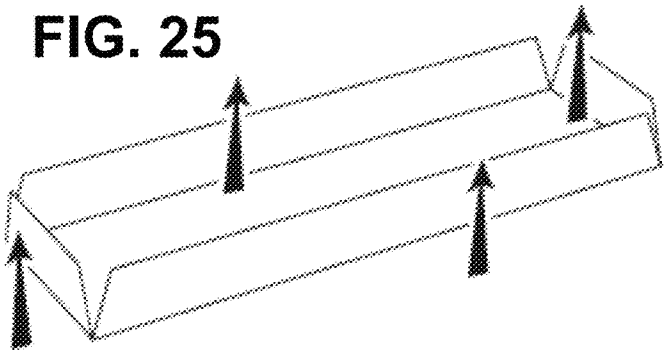
FIGS. 25-27 illustrate the steps of folding a riser and inserting it onto a shelf in the display.
Figure 26:
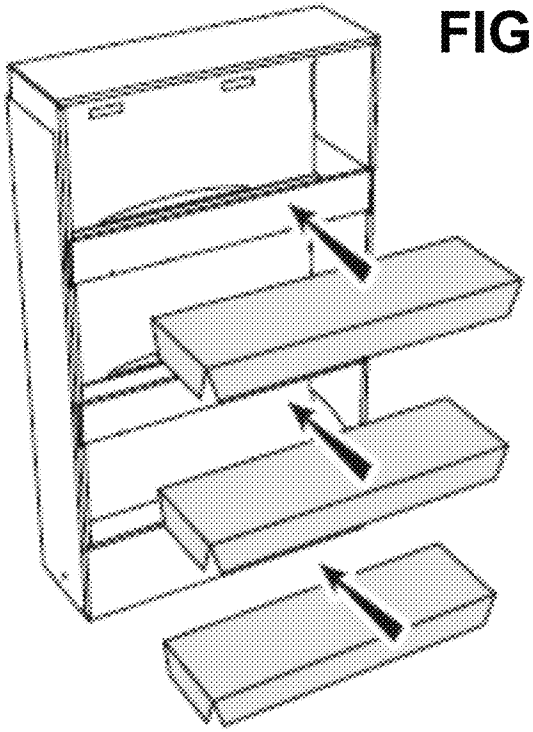
Figure 27:
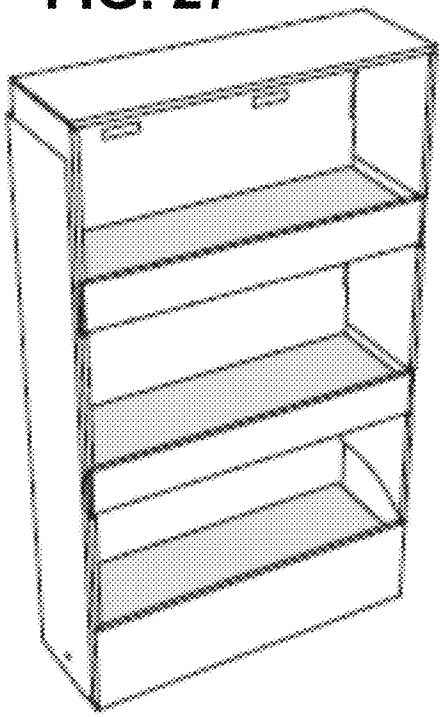

A riser is folded from a blank 292 and is incorporated into the display as shown in FIGS. 25-27.

Figure 28:
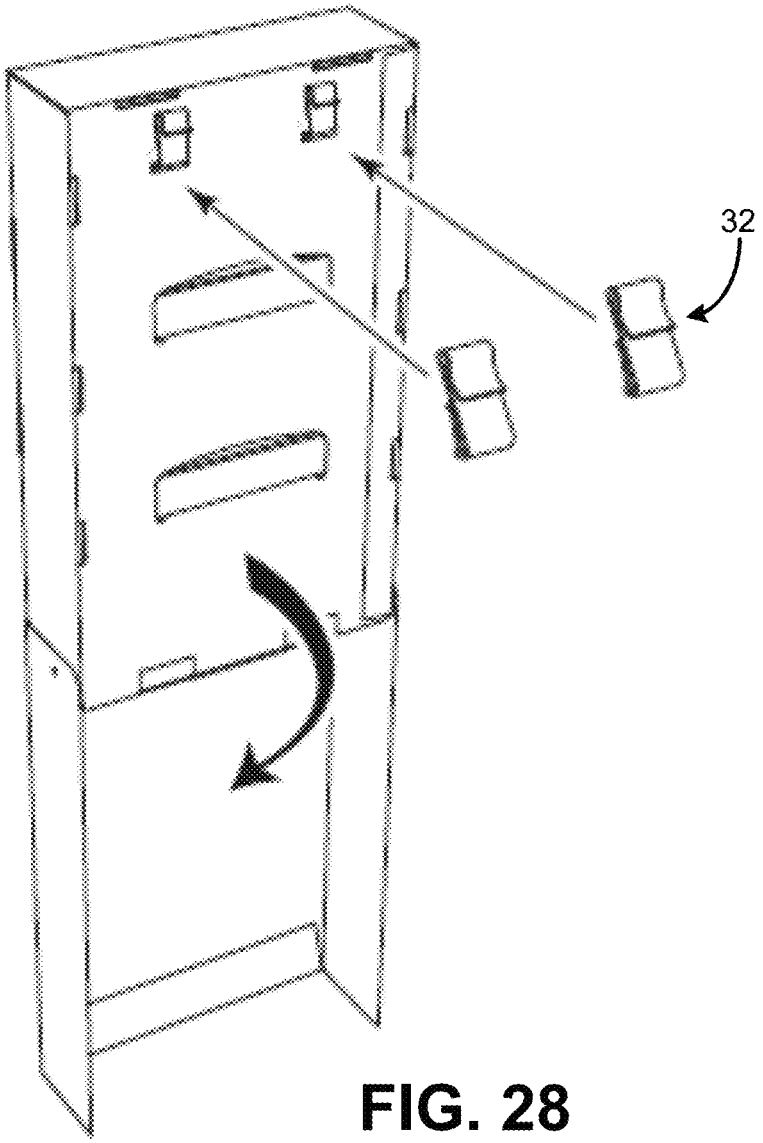
FIG. 28 shows a rear perspective view of a display utilizing a U-shaped clip for retaining blanks in a stowed condition.

FIG. 28 shows how U-shaped clips 32 inserted into the holes 232 and are used to hold the blanks for forming the drawers, risers, platforms during shipment.

The corrugated paper of the present invention can be corrugated paperboard, paper board, plastic sheeting, corrugated plastic material, and tri-laminate plastic material.

Many modifications and variations of the present invention are possible in light of the above teachings. It is, therefore, to be understood within the scope of the appended claims the invention may be protected otherwise than as specifically described.

We claim:

1. A display moveable from a stowed position to a deployed position comprising:

a first portion having a back wall, a first side wall extending from a first side of the back wall, a second side wall extending from a second side of the back wall and a plurality of shelves extending from the back wall between the first side wall and the second side wall; and, a second portion hingedly connected to the first portion by a first fastener and a second fastener, the second portion having a first wall, a first side wall extending from a first side of the first wall and a second side wall extending from a second side of the first wall, wherein the first side wall of the second portion is positioned proximate an outer surface of the first side wall of the first portion and the second side wall of the second portion is positioned proximate an outer surface of the second side wall of the first portion when in the stowed position and wherein the second portion extends below the first portion when in the deployed position.

2. The display of claim 1 wherein the first wall of the second portion is positioned proximate an outer surface of the back wall when the display is in the stowed position.

3. The display of claim 2 wherein the first wall of the second portion extends below a front of the first portion when the display is in the deployed position.

4. The display of claim 1 wherein the first wall of the second portion has a height substantially equal to a height of the back wall of the first portion.

5. The display of claim 1 wherein the first wall of the second portion has a height greater than a height of the back wall of the first portion.

6. The display of claim 1 wherein the first fastener and the second fastener are adjustable.

7. The display of claim 6 wherein the first portion includes a first hole proximate a bottom portion of the first side wall of the first portion and a second hole proximate a bottom portion of the second side wall of the first portion, and the second portion includes a first hole in the first side wall of the second portion and a second hole in the second side wall of the second portion.

8. The display of claim 6 wherein the first fastener is positioned between the first hole in the first side wall of the first portion and the first hole in the first side wall of the second portion, and the second fastener is positioned between the second hole in the second side wall of the first portion and second hole in the second side wall of the second portion.

9. The display of claim 1 further comprising a header panel attached to the first portion.

10. The display of claim 3 wherein the first portion includes a first slot in a bottom portion of the back wall.

11. The display of claim 10 wherein the second portion includes a first tab extending outward from an edge of the first wall wherein the first tab is configured to cooperate with the first slot in the back wall of the first portion.

12. The display of claim 11 wherein the first portion includes a second slot in the bottom portion spaced from the first slot and wherein the second portion includes a second tab extending outward from the edge of the first wall wherein the second tab is configured to cooperate with the second slot in the back wall of the first portion.

13. The display of claim 1 wherein the first portion includes a bottom wall extending from between the first side wall of the first portion and the second side wall of the first portion, wherein the bottom wall is below the plurality of shelves.

14. The display of claim 1 wherein the first portion is formed from a first blank of corrugated material.

15. The display of claim 14 wherein the second portion is formed from a second blank of corrugated material.

16. A display moveable from a stowed position to a deployed position comprising:

a first portion having a back wall, a first side wall extending from a first side of the back wall, a second side wall extending from a second side of the back wall and a plurality of shelves extending from the back wall between the first side wall and the second side wall; and, a second portion hingedly connected to the first portion, the second portion having a first wall, a first side wall extending from a first side of the first wall and a second side wall extending from a second side of the first wall, wherein the first side wall of the second portion is positioned proximate an outer surface of the first side wall of the first portion and the second side wall of the second portion is positioned proximate an outer surface of the second side wall of the first portion when in the stowed position and wherein the second portion extends below the first portion when in the deployed position, wherein the first wall of the second portion is positioned proximate an outer surface of the back wall when the display is in the stowed position and the first wall of the second portion extends below a front of the first portion when the display is in the deployed position, and wherein the first portion includes a first slot in a bottom portion of the back wall and the second portion includes a first tab extending outward from an edge of the first wall wherein the first tab is configured to cooperate with the first slot in the back wall of the first portion.

17. The display of claim 16 wherein the first portion includes a second slot in the bottom portion spaced from the first slot and wherein the second portion includes a second tab extending outward from the edge of the first wall wherein the second tab is configured to cooperate with the second slot in the back wall of the first portion.

* * * * *